US012180965B2

(12) United States Patent
Kim et al.

(10) Patent No.: US 12,180,965 B2
(45) **Date of Patent: *Dec. 31, 2024**

(54) COMPRESSOR

(71) Applicant: LG Electronics Inc., Seoul (KR)

(72) Inventors: Jinho Kim, Seoul (KR); Kangwook Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/920,258

(22) PCT Filed: Apr. 13, 2021

(86) PCT No.: PCT/KR2021/004628
§ 371 (c)(1),
(2) Date: Oct. 20, 2022

(87) PCT Pub. No.: WO2021/215734
PCT Pub. Date: Oct. 28, 2021

(65) Prior Publication Data

US 2023/0175507 A1 Jun. 8, 2023

(30) Foreign Application Priority Data

Apr. 20, 2020 (KR) ..... 10-2020-0047700

(51) Int. Cl.
*F04C 18/00* (2006.01)
*F04C 18/02* (2006.01)
(Continued)

(52) U.S. Cl.
CPC ..... *F04C 29/02* (2013.01); *F04C 18/0215* (2013.01); *F04C 29/12* (2013.01);
(Continued)

(58) Field of Classification Search
CPC ..... F04C 18/0215; F04C 18/0261; F04C 23/008; F04C 29/02; F04C 29/023;
(Continued)

(56) References Cited

U.S. PATENT DOCUMENTS 4,669,962 A * 6/1987 Mizuno ..... F04C 27/005 418/94
2002/0098102 A1 7/2002 Gennami et al.
(Continued)

FOREIGN PATENT DOCUMENTS

JP H073228 1/1995
JP 2002-257062 9/2002
(Continued)

OTHER PUBLICATIONS

JP6344452B2—Toyama et al.—Compressor—Jun. 20, 2018—English Machine Translation (Year: 2018).*
(Continued)

*Primary Examiner* — Theresa Trieu
(74) *Attorney, Agent, or Firm* — Fish & Richardson P.C.

(57) ABSTRACT

The present invention relates to a compressor wherein, when oil is supplied to a single module, the module can mechanically/structurally supply the oil to a plurality of regions in a selective manner according to the pressure of a refrigerant, etc.

16 Claims, 8 Drawing Sheets

(51) Int. Cl.

| | |
|---|---|
| ***F04C 29/00*** | (2006.01) |
| ***F04C 29/02*** | (2006.01) |
| ***F04C 29/12*** | (2006.01) |

(52) U.S. Cl.
CPC ..... *F04C 2210/26* (2013.01); *F04C 2240/20* (2013.01); *F04C 2240/30* (2013.01); *F04C 2240/809* (2013.01)

(58) Field of Classification Search
CPC ..... F04C 29/025; F04C 29/028; F04C 29/12; F04C 2210/26; F04C 2230/604; F04C 2240/20; F04C 2240/30; F04C 2240/60; F04C 2240/603; F04C 2240/809; F05B 2210/14; F05B 2240/20; F05B 2260/98
See application file for complete search history.

(56) References Cited

U.S. PATENT DOCUMENTS

| | | | | |
|---|---|---|---|---|
| 2004/0156734 | A1* | 8/2004 | Furusho | F04C 27/005 418/55.6 |
| 2018/0223850 | A1* | 8/2018 | Toyama | F04C 18/0215 |
| 2018/0328362 | A1* | 11/2018 | Kim | F04C 18/0215 |

FOREIGN PATENT DOCUMENTS

| | | | | |
|---|---|---|---|---|
| JP | 2004027928 | A * | 1/2004 | F04C 29/12 |
| KR | 19890003862 | | 10/1989 | |
| KR | 1020180124636 | A * | 11/2018 | F04C 18/0215 |
| KR | 101934295 | | 1/2019 | |

OTHER PUBLICATIONS

International Search Report and Written Opinion in International Appln. No. PCT/KR2021/004628, dated Aug. 5, 2021, 16 pages (with English translation).

* cited by examiner

COMPRESSOR

CROSS-REFERENCE TO RELATED APPLICATIONS

This application is a National Stage application under 35 U.S.C. § 371 of International Application No. PCT/KR2021/004628, filed on Apr. 13, 2021, which claims the benefit of Korean Application No. 10-2020-0047700, filed on Apr. 20, 2020. The disclosures of the prior applications are incorporated by reference in their entirety.

TECHNICAL FIELD

The present disclosure relates to a compressor. More specifically, the present disclosure relates to a scroll compressor having an oil supply passage that may supply oil to compressing portion in which a refrigerant is compressed.

BACKGROUND ART

In general, a compressor, as a device applied to a refrigeration cycle (hereinafter, abbreviated as the refrigeration cycle) such as a refrigerator or an air conditioner, is a device that compresses a refrigerant so as to perform an operation necessary for a heat exchange to occur in the refrigeration cycle.

The compressors may be divided into a reciprocating compressor, a rotary compressor, a scroll compressor, and the like based on a scheme of compressing the refrigerant. Among them, the scroll compressor is a compressor that forms a compression chamber between a fixed wrap of a fixed scroll and an orbiting wrap of an orbiting scroll as the orbiting scroll is engaged with and orbits the fixed scroll fixed in an inner space of a sealed container.

Because the scroll compressor is continuously compressed via shapes of scrolls in engagement with each other, the scroll compressor may obtain a relatively high compression ratio compared to other types of compressors. In addition, because suction, compression, and discharge strokes of the refrigerant are smooth, the scroll compressor may obtain a stable torque. For this reason, the scroll compressor is widely used for refrigerant compression in the air conditioner and the like.

Referring to Japanese Patent No. 6344452, a conventional scroll compressor includes a casing that forms an outer appearance of the compressor and has a discharge portion through which a refrigerant is discharged, compressing portion fixed to the casing so as to compress the refrigerant, and a driver fixed to the casing and driving the compressing portion, and the compressing portion and the driver are connected to each other by a rotating shaft coupled to the driver and rotating.

The compressing portion includes a fixed scroll fixed to the casing and having a fixed wrap, and an orbiting scroll including an orbiting wrap driven in engagement with the fixed wrap by the rotating shaft. In such conventional scroll compressor, the rotating shaft is eccentric and the orbiting scroll rotates by being fixed to the eccentric rotating shaft. Therefore, the orbiting scroll compresses the refrigerant while orbiting along the fixed scroll.

In such a conventional scroll compressor, it is common that the compressing portion is disposed below the discharge portion and the driver is disposed below the compressing portion. One end of the rotating shaft is coupled to the compressing portion, and the other end thereof extends through the driver.

In the conventional scroll compressor, because the compressing portion is disposed above the driver and is disposed close to the discharge portion, it was difficult to supply oil to the compressing portion. In addition, there was a disadvantage that a lower frame is additionally needed to separately support the rotating shaft connected to the compressing portion from a position below the driver. In addition, the conventional scroll compressor had a problem in that an efficiency and a reliability are lowered as the scroll tilts because action points of a gas force generated by the refrigerant inside the compressor and a reaction force supporting the same do not coincide with each other.

In order to solve such problem, referring to Korean Patent Application Publication No. 10-2018-0124636, recently, a scroll compressor in which the driver is located below the discharge portion and the compressing portion is located below the driver has appeared (as known as a lower scroll compressor or a through-shaft scroll compressor).

The through-shaft scroll compressor has an advantage of smooth oil supply because compressing portion 300 is disposed closer to an oil storage space than the driver. In addition, because the compressing portion 300 itself supports the rotating shaft extending from the driver, a structure for separately supporting the rotating shaft is omitted, so that a structure of the through-shaft scroll may be simplified.

In addition, when the rotating shaft completely passes through the compressing portion 300, because the rotating shaft supports a vibration or a pressure generated from the compressing portion 300 in a longitudinal direction, there is an advantage in that the reliability of the compressor is improved.

FIG. 1 shows a structure of a compressing portion of a conventional compressor in detail.

Referring to (a) in FIG. 1, the compressing portion may include an orbiting scroll 330 for rotatably accommodating a rotating shaft 230 therein, a fixed scroll 320 that is engaged with the orbiting scroll so as to form a compression chamber in which the refrigerant is compressed, and a main frame 310 mounted on the fixed scroll 320 so as to accommodate the orbiting scroll 330 therein.

A portion of the rotating shaft 230 accommodated in the orbiting scroll 330 may include an eccentric shaft 232 whose diameter is extended so as to be biased to one side. Accordingly, as the rotating shaft 230 rotates, the eccentric shaft 232 may press the orbiting scroll 330 along a circumference of the fixed scroll 320 so as to continuously compress the refrigerant flowing along the orbiting scroll 330 and the fixed scroll 320.

Because the orbiting scroll 330 and the fixed scroll 320 may cause friction in the process of compressing the refrigerant, and may overheat as a temperature of the refrigerant rises, the conventional compressor may further include an oil supply passage for passing the oil through the rotating shaft 230, the main frame 310, and the fixed scroll 320. The oil supply passage I is extended to a region facing the orbiting wrap 333 of the orbiting scroll 330, thereby delivering the oil to the compression chamber.

The oil supply passage I may be composed of a supply passage 234 defined in the rotating shaft 230, a delivery passage 319 defined in the main frame 310, and a fixed passage 329 defined in the fixed scroll 320.

The refrigerant is actually discharged from the fixed scroll 320, a region adjacent to the rotating shaft 230 corresponds to a high-pressure region S1, and a region where the refrigerant actually starts to be compressed between the fixed scroll and the orbiting scroll corresponds to an intermediate-pressure region V1 with a pressure lower than that of the high-pressure region S1. Accordingly, the oil supply passage I may supply the oil from the supply passage 234 to the intermediate-pressure region V1 without additional power because of a pressure difference between the high-pressure region S1 and the intermediate-pressure region V1.

In one example, when the conventional compressor is used in the air conditioner and the like, because a temperature difference between indoor and outdoor is not relatively great, the compressor compresses the refrigerant at a relatively low pressure such as a pressure ratio from 1.1 to 1.3 (as known as low pressure ratio driving).

When the conventional compressor is driven at the low pressure ratio, because the pressure difference between the high-pressure region S1 and the intermediate-pressure region V1 is not great, the oil is not able to be smoothly supplied to the oil supply passage I. That is, the conventional compressor had a problem in that a bearing is damaged due to interruption of the oil supply and an insufficient oil supply amount during the low pressure ratio driving.

In preparation for such problems, in the compressor, a low-pressure oil supply passage II defined to supply the oil to a low-pressure region V2 that is located outwardly of the intermediate-pressure region V1 was able to be defined. The low-pressure oil supply passage II may be defined to further secure the pressure difference by advancing an oil supply start time compared to the oil supply passage I. However, when the compressor compresses the refrigerant above the low pressure ratio, because the pressure difference between the high-pressure region S1 and the low-pressure region V2 becomes very great, the low-pressure oil supply passage II had a problem of excessive supply of the oil.

Accordingly, recently, a method for separately defining the low-pressure oil supply passage II and the oil supply passage I in the conventional compressor has been studied. However, even in this case, because of the fundamental limitation of the low-pressure oil supply passage II, when the low pressure ratio driving is not performed, the problem that the oil is excessively supplied via the low-pressure oil supply passage II was not able to be solved. Therefore, in the prior art, the compressor having the low-pressure oil supply passage II was not able to be applied other than to the low pressure ratio driving.

Accordingly, in the prior art, there was an inefficiency in that a compressor having a normal oil supply passage and a compressor having a low-pressure oil supply passage must be separately manufactured based on driving conditions of the compressor.

DISCLOSURE

Technical Problem

The present disclosure is to provide a compressor capable of supplying oil to a plurality of regions from a module when the oil is supplied to the module.

The present disclosure is to provide a compressor that may supply oil to all or selected regions of a plurality of regions via one oil supply passage.

The present disclosure is to provide a compressor in which, when the compressor is driven at a low pressure ratio such as a compression ratio from 1.1 to 1.3, a passage for supplying oil to a low-pressure region where a refrigerant starts to be compressed or where the compression is only partially performed is opened, and when the compressor is driven at a pressure ratio higher than the low pressure ratio, the oil supply to the low-pressure region is able to be blocked.

The present disclosure is to provide a compressor capable of selectively supplying oil to a plurality of regions (e.g., a low-pressure region and a high-pressure region) via one oil supply passage.

The present disclosure is to provide a compressor that may be in communication with both a low-pressure oil supply passage suitable for low pressure ratio driving and a normal oil supply passage suitable for normal driving at a compression ratio equal to or higher than the ratio range from 1.1 to 1.3 so as to determine oil supply to the passages.

The present disclosure is to provide a compressor in which whether to open and close a low-pressure oil supply passage may be determined in response to a pressure of a discharged refrigerant.

The present disclosure is to provide a compressor that may supply oil both of a case of being driven at a low pressure ratio and a case of being driven in a normal state.

The present disclosure is to provide a compressor that allows oil to be sufficiently supplied while being driven at a low pressure ratio, and prevents excessive oil supply while being driven in a normal state.

Technical Solutions

In order to solve the above problems, the present disclosure provides a compressor including a low pressure ratio oil supply passage for a low pressure ratio operation region and an oil supply passage for a normal operation range. In such compressor, an oil supply passage through which oil is supplied via a valve operated by a discharge pressure of a refrigerant may be selected. The valve may not be controlled by an electric signal, but may be mechanically and semi-automatically controlled by the refrigerant or an internal pressure of a compressor casing.

The present disclosure may provide a compressor including adjusting portion that may be in communication with both a low-pressure oil supply passage suitable for low pressure ratio driving and a normal oil supply passage suitable for normal driving at a compression ratio equal to or higher than a ratio range from 1.1 to 1.3 so as to determine oil supply to the passages.

The adjusting portion may determine a supply region of the oil based on a pressure of the refrigerant discharged by the compressor. When the refrigerant is discharged at a low-pressure via the adjusting portion, an interior of the compressor according to the present disclosure will be in a low-pressure state, so that the oil may be supplied to the low-pressure region. When the refrigerant is discharged at a high-pressure, the interior of the compressor will be in a high-pressure state, so that the oil may be supplied to the high-pressure region.

In order to solve the above-mentioned problem, the present disclosure provides a compressor that may reduce low pressure ratio oil supply interruption by defining a low pressure ratio oil supply passage and a normal operation oil supply passage separately from each other and operating the valve based on a pressure ratio.

The valve may be controlled passively, immediately, and mechanically based on the pressure of the refrigerant, without the separate electronic control.

The low pressure ratio oil supply line of the compressor according to the present disclosure may be in communication with a suction hole for smooth oil supply even at a pressure ratio equal to or lower than 1.1.

The compressor according to the present disclosure may be provided to define a suction hole direct oil injection oil supply line for oil in an oil storage portion, which is a discharge pressure space, after decompression via a decompressing pin.

The compressor according to the present disclosure may increase an oil supply amount when being driven at the low pressure ratio, and may block efficiency degradation as the oil supply amount is adjusted under normal operating conditions.

Advantageous Effects

According to the present disclosure, when the oil is supplied to one module, the oil may be supplied to the plurality of regions from the module.

According to the present disclosure, the oil may be supplied to all of the plurality of regions (e.g., the low-pressure region and the high-pressure region) via one oil supply passage.

According to the present disclosure, the passage for supplying the oil to the low-pressure region may be opened during the low pressure ratio driving such as the compression ratio from 1.1 to 1.3, and the oil supply to the low-pressure region may be blocked during the normal driving.

According to the present disclosure, the oil may be selectively supplied to the plurality of regions (e.g., the low-pressure region and the high-pressure region) via one oil supply passage.

According to the present disclosure, the compressor that may be in communication with both the low-pressure oil supply passage suitable for the low pressure ratio driving and the normal oil supply passage suitable for the normal driving at the compression ratio equal to or higher than the ratio range from 1.1 to 1.3 so as to determine the oil supply to the passages.

According to the present disclosure, whether to open and close the low-pressure oil supply passage may be determined in response to the pressure of the discharged refrigerant.

According to the present disclosure, the oil may be supplied both of the case of the low pressure ratio driving and the case of the driving in the normal state.

According to the present disclosure, the oil may be sufficiently supplied during the low pressure ratio driving and the excessive oil supply may be prevented during the driving in the normal state.

BEST MODE

Figure 1:
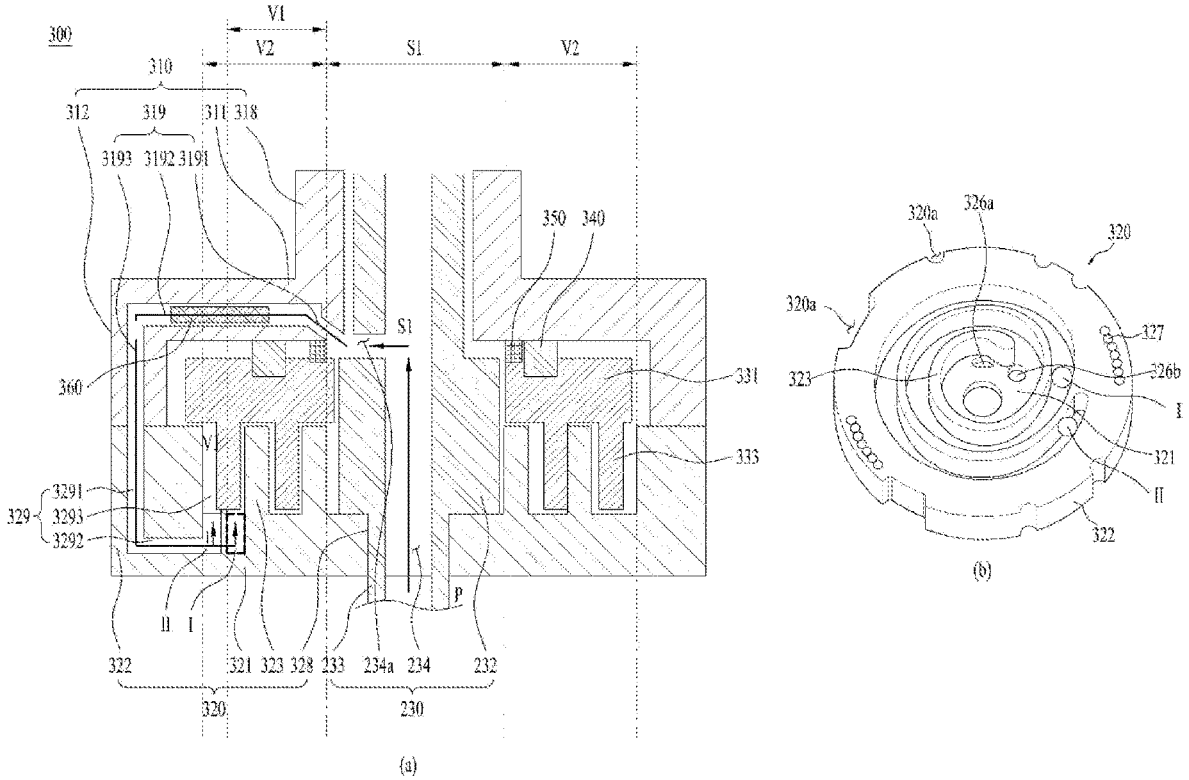
FIG. 1 shows a structure of a conventional compressor.

Hereinafter, embodiments disclosed in the present specification will be described in detail with reference to the accompanying drawings. In the present specification, even in different embodiments, the same and similar reference numerals are assigned to the same and similar components, and the description thereof is replaced with the first description. As used herein, the singular expression includes the plural expression unless the context clearly dictates otherwise. In addition, in describing the embodiments disclosed herein, when it is determined that a detailed description of a related known technology may obscure the gist of the embodiments disclosed herein, a detailed description thereof will be omitted. In addition, the accompanying drawings are only for easy understanding of the embodiments disclosed in the present specification, and it should be noted that the technical idea disclosed in the present specification is not to be construed as being limited by the accompanying drawings.

Figure 2:
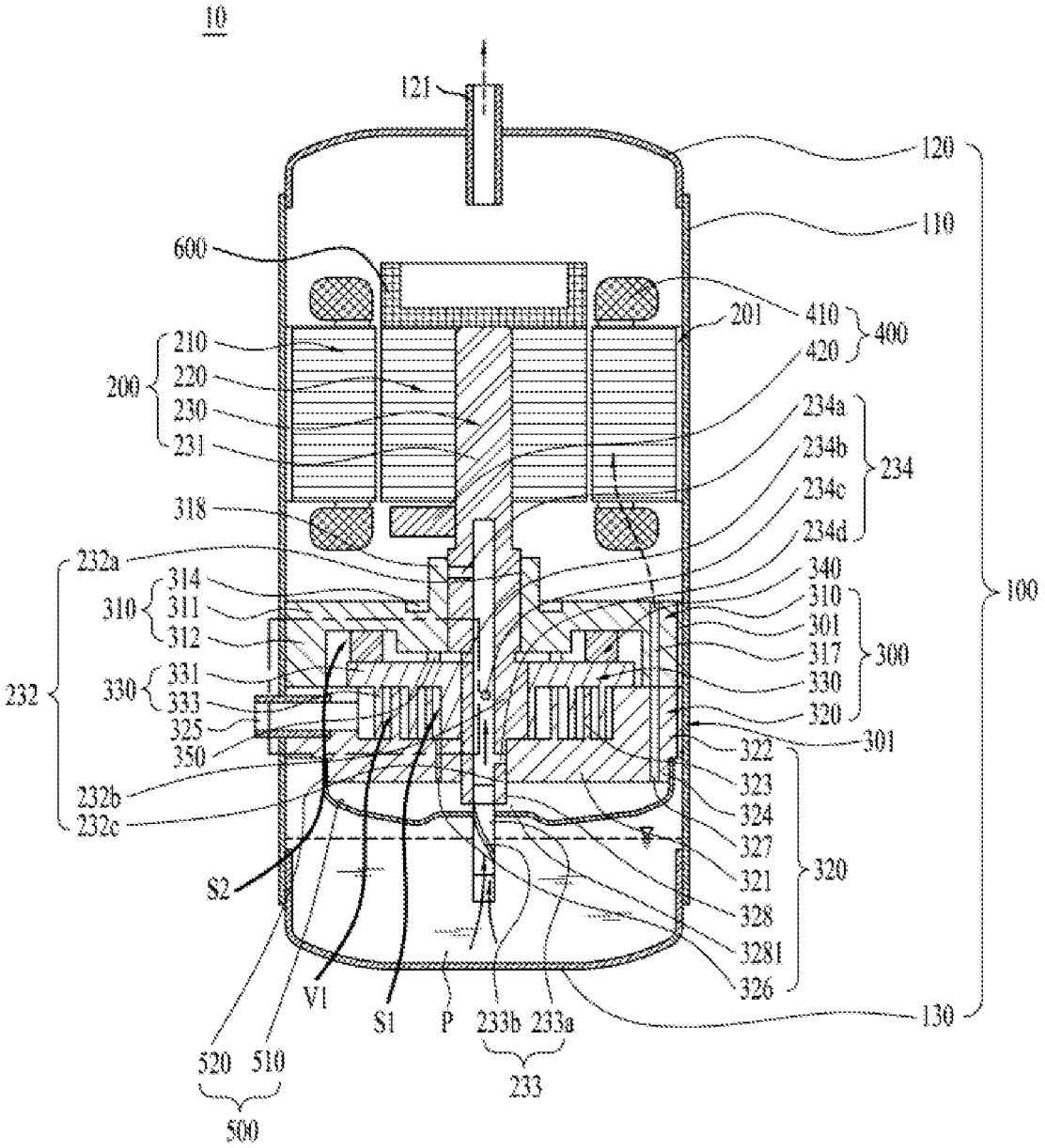
FIG. 2 shows a basic structure of a compressor according to the present disclosure.

FIG. 2 illustrates a basic structure of a compressor according to an embodiment of the present disclosure. A scroll compressor 10 according to the present disclosure is generally installed on a circuit of a refrigerant cycle equipped with a condenser, an expansion valve, and an evaporator.

The scroll compressor 10 according to an embodiment of the present disclosure may include a casing 100 having a space in which a fluid is stored or flows defined therein, a driver 200 coupled to an inner circumferential surface of the casing 100 to rotate a rotating shaft 230, and compressing portion 300 disposed inside the casing and coupled to the rotating shaft 230 so as to compress the fluid.

Specifically, the casing 100 may have a discharge portion 121 through which a refrigerant is discharged at one side thereof. The casing 100 may include an accommodating shell 110 formed in a cylindrical shape so as to accommodate the driver 200 and the compressing portion 300 therein, a discharge shell 120 coupled to one end of the accommodating shell 110 and equipped with the discharge portion 121, and a blocking shell 130 coupled to the other end of the accommodating shell 110 so as to seal the accommodating shell 110.

The driver 200 may include a stator 210 for generating a rotating magnetic field, and a rotor 220 provided to rotate by the rotating magnetic field, and the rotating shaft 230 may be coupled to the rotor 220 to rotate together with the rotor 220.

The stator 210 may have multiple slots defined along a circumferential direction in an inner circumferential surface thereof and a coil wound in the slots, and may be fixed to an inner circumferential surface of the accommodating shell 110. The rotor 220 may be coupled with a permanent magnet and disposed inside the stator 210 and rotatably coupled to the stator 210 so as to generate rotational power. The rotating shaft 230 may be press-fitted into a center of the rotor 220 and coupled to the rotor 220.

The compressing portion 300 may include a fixed scroll 320 coupled to the accommodating shell 110 and disposed on a side of the driver 200 far from the discharge portion 121, an orbiting scroll 330 coupled to the rotating shaft 230 and engaged with the fixed scroll 320 so as to form a compression chamber, and a main frame 310 that accommodates the orbiting scroll 330 therein and is mounted on the fixed scroll 320 to form an outer appearance of the compressing portion 300.

As a result, in the scroll compressor 10, the driver 200 is disposed between the discharge portion 121 and the compressing portion 300. In other words, the driver 200 may be disposed on one side of the discharge portion 121, and the compressing portion 300 may be disposed on the side of the driver 200 far from the discharge portion 121. For example, when the discharge portion 121 is disposed at an upper portion of the casing 100, the compressing portion 300 may be disposed at a lower portion of the driver 200, and the driver 200 may be disposed between the discharge portion 121 and the compressing portion 300.

Accordingly, when oil is stored in the casing 100, the oil may be directly supplied to the compressing portion 300 without passing through the driver 200. In addition, because the rotating shaft 230 is coupled to and supported by the compressing portion 300, a separate lower frame for rotatably supporting the rotating shaft separately may be omitted.

In one example, the scroll compressor 10 according to the present disclosure may be provided such that the rotating shaft 230 passes through the orbiting scroll 330 as well as the fixed scroll 320 and is in surface contact with both the orbiting scroll 330 and the fixed scroll 320.

Therefore, an inflow force generated when the fluid such as the refrigerant flows into the compressing portion 300, a gas force generated when the refrigerant is compressed inside the compressing portion 300, and a reaction force supporting the same may act on the rotating shaft 230 as it is. Accordingly, the inflow force, the gas force, and the reaction force may be applied to one action point on the rotating shaft 230. Accordingly, because an overturning moment does not act on the orbiting scroll 330 coupled to the rotating shaft 230, the orbiting scroll may be fundamentally blocked from tilting or overturning. In other words, up to axial vibration of the vibration occurring in the orbiting scroll 330 may be attenuated or prevented, and the overturning moment of the orbiting scroll 330 may also be attenuated or suppressed. Therefore, noise and vibration generated by the lower scroll compressor 10 may be blocked. In addition, because the fixed scroll 320 is in surface contact with and supports the rotating shaft 230, even when the input force and the gas force act on the rotating shaft 230, durability of the rotating shaft 230 may be reinforced. In addition, the rotating shaft 230 may partially absorb a discharge pressure generated as the refrigerant is discharged to the outside, thereby reducing a force (a normal force) allowing the orbiting scroll 330 and the fixed scroll 320 to be in close contact with each other excessively in an axial direction. As a result, a friction force between the orbiting scroll 330 and the fixed scroll 320 may also be greatly reduced.

As a result, the compressor 10 may attenuate the shaking in the axial direction and the overturning moment of the orbiting scroll 330 inside the compressing portion 300, and reduce the friction force of the orbiting scroll, thereby improving an efficiency and a reliability of the compressing portion 300.

In one example, the main frame 310 of the compressing portion 300 may include a main end plate 311 disposed on one side of the driver 200 or at a lower portion of the driver 200, a main side plate 312 extending in a direction away from the driver 200 from an inner circumferential surface of the main end plate 311 and mounted on the fixed scroll 320, and a main shaft accommodating portion 318 extending from the main end plate 311 so as to rotatably support the rotating shaft 230.

A main hole 317 for guiding the refrigerant discharged from the fixed scroll 320 to the discharge portion 121 may be further defined in the main end plate 311 or the main side plate 312.

The main end plate 311 may further include an oil pocket 314 defined in a concave shape outwardly of the main shaft accommodating portion 318. The oil pocket 314 may be defined in an annular shape, and may be defined so as to be eccentric from the main shaft accommodating portion 318. The oil pocket 314 may be defined such that, when the oil stored in the blocking shell 130 is transmitted via the rotating shaft 230 and the like, the oil may be supplied to a portion where the fixed scroll 320 and the orbiting scroll 330 are engaged with each other.

The fixed scroll 320 may include a fixed end plate 321 disposed on a side of the main end plate 311 far from the driver 200 and coupled to the accommodating shell 110 so as to form the other surface of the compressing portion 300, a fixed side plate 322 extending from the fixed end plate 321 toward the discharge portion 121 and in contact with the main side plate 312, and a fixed wrap 323 disposed on an inner circumferential surface of the fixed side plate 322 so as to form the compression chamber in which the refrigerant is compressed.

In one example, the fixed scroll 320 may include a fixed through-hole 328 defined such that the rotating shaft 230 passes therethrough, and a fixed shaft accommodating portion 3281 extending from the fixed through-hole 328 so as to rotatably support the rotating shaft. The fixed shaft accommodating portion 3281 may be disposed at a center of the fixed end plate 321.

A thickness of the fixed end plate 321 may be equal to a thickness of the fixed shaft accommodating portion 3281. In this regard, the fixed shaft accommodating portion 3281 may not protrude and extend from the fixed end plate 321, but may be embedded in the fixed through-hole 328.

The fixed side plate 322 may have a suction hole 325 defined therein for introducing the refrigerant into the fixed wrap 323, and the fixed end plate 321 may have a discharge hole 326 defined therein for discharging the refrigerant. The discharge hole 326 may be defined at a center of the fixed wrap 323, but in order to avoid interference with the fixed shaft accommodating portion 3281, the discharge hole 326 may be defined to be spaced apart from the fixed shaft accommodating portion 3281 and may include a plurality of discharge holes.

The orbiting scroll 330 may include an orbiting end plate 331 disposed between the main frame 310 and the fixed scroll 320, and an orbiting wrap 333 forming the compression chamber together with the fixed wrap 323 on the orbiting end plate.

The orbiting scroll 330 may further include an orbiting through-hole 338 defined through the orbiting end plate 331 such that the rotating shaft 230 is rotatably supported.

The rotating shaft 230 may be provided such that a portion thereof coupled to the orbiting through-hole 338 is eccentric. Accordingly, when the rotating shaft 230 rotates, the orbiting scroll 330 may move in engagement with the fixed wrap 323 of the fixed scroll 320 and may compress the refrigerant.

Specifically, the rotating shaft 230 may include a main shaft 231 coupled to the driver 200 and rotating, and a support shaft 232 connected to the main shaft 231 and rotatably coupled to the compressing portion 300. The support shaft 232 may be formed as a member separate from the main shaft 231 and may accommodate the main shaft 231 therein, or may be formed integrally with the main shaft 231.

The support shaft 232 may include a main support shaft **232*a* that is inserted into the main shaft accommodating portion 318 of the main frame 310 so as to be rotatably supported, a fixed support shaft 232*c* that is inserted into the fixed shaft accommodating portion 3281 of the fixed scroll 320 so as to be rotatably supported, and an eccentric shaft 232*b* that is disposed between the main support shaft 232*a*** and the fixed support shaft 232*c* and is rotatably supported by being inserted into the orbiting through-hole 338 of the orbiting scroll 330.

In this regard, the main support shaft 232*a* and the fixed support shaft 232*c* may be formed coaxially to have the same axis center, and the eccentric shaft 232*b* may be formed such that a center of gravity thereof is radially eccentric with respect to the main support shaft 232*a* or the fixed support shaft 232*c*. In addition, an outer diameter of the eccentric shaft 232*b* may be greater than an outer diameter of the main support shaft 232*a* or an outer diameter of the fixed support shaft 232*c*. Accordingly, the eccentric shaft 232*b* may provide a force to compress the refrigerant while allowing the orbiting scroll 330 to orbit when the support shaft 232 rotates, and the orbiting scroll 330 may orbit the fixed scroll 320 regularly by the eccentric shaft 232*b*.

In order to prevent the orbiting scroll 330 from rotating, the compressor 10 according to the present disclosure may further include an Oldham's ring 340 coupled to the orbiting scroll 330 from above. The Oldham's ring 340 may be disposed between the orbiting scroll 330 and the main frame 310 so as to be in contact with both the orbiting scroll 330 and the main frame 310. The Oldham's ring 340 is provided to move linearly in four directions of a forward direction, a rearward direction, a leftward direction, and a rightward direction so as to prevent the rotation of the orbiting scroll 330.

In one example, the rotating shaft 230 may completely extend through the fixed scroll 320 and protrude outwardly of the compressing portion 300. Accordingly, a region outside of the compressing portion 300, the oil stored in the blocking shell 130, and the rotating shaft 230 may be in direct contact with each other, and the rotating shaft 230 may supply the oil into the compressing portion 300 while rotating.

The oil may be supplied to the compressing portion 300 via the rotating shaft 230. The oil supply passage 234 for supplying the oil to an outer circumferential surface of the main support shaft 232*a*, an outer circumferential surface of the fixed support shaft 232*c*, and an outer circumferential surface of the eccentric shaft 232*b* may be defined inside the rotating shaft 230.

In addition, a plurality of oil supply holes 234*a, b, c*, and *d* may be defined in the oil supply passage 234. Specifically, the oil supply holes may include a first oil supply hole 234*a*, a second oil supply hole 234*b*, a third oil supply hole 234*c*, and a fourth oil supply hole 234*d*. First, the first oil supply hole 234*a* may be defined to extend through the outer circumferential surface of the main support shaft 232*a*.

In the oil supply passage 234, the first oil supply hole 234*a* may be defined to extend through the outer circumferential surface of the main support shaft 232*a*. In addition, the first oil supply hole 234*a* may be defined, for example, to extend through an upper portion of the outer circumferential surface of the main support shaft 232*a*, but the present disclosure may not be limited thereto. That is, the first oil supply hole 234*a* may be defined to extend through a lower portion of the outer circumferential surface of the main support shaft 232*a*. For reference, the first oil supply hole 234*a* may include a plurality of holes, unlike the one illustrated in the drawing. In addition, when the first oil supply hole 234*a* include the plurality of holes, the hole may be defined only in the upper portion or the lower portion of the outer circumferential surface of the main support shaft 232*a*, or the holes may be defined in the upper portion and the lower portion of the outer circumferential surface of the main support shaft 232*a*, respectively.

In addition, the rotating shaft 230 may include an oil shaft 233 provided to be in contact with the oil stored in the casing 100 through a muffler 500 to be described later. The oil shaft 233 may include an extension shaft 233*a* extending through the muffler 500 so as to be in contact with the oil, and a spiral groove 233*b* helically defined in an outer circumferential surface of the extension shaft 233*a* and in communication with the supply passage 234.

Accordingly, when the rotating shaft 230 rotates, because of the spiral groove 233*b*, a viscosity of the oil, and a pressure difference between a high-pressure region S1 and an intermediate-pressure region V1 inside the compressing portion 300, the oil ascends via the oil shaft 233 and the supply passage 234, and is discharged to the plurality of oil supply holes. The oil discharged via the plurality of oil supply holes 234*a*, 234*b*, 234*c*, and 234*d* may form an oil film between the fixed scroll 250 and the orbiting scroll 240 so as to maintain an airtight state, and absorb a frictional heat generated in a portion where the components of the compressing portion 300 rub against each other so as to dissipate the heat.

The oil guided along the rotating shaft 230 and supplied via the first oil supply hole 234*a* may lubricate the main frame 310 and the rotating shaft 230. In addition, the oil may be discharged via the second oil supply hole 234*b* and supplied to a top surface of the orbiting scroll 240, and the oil supplied to the top surface of the orbiting scroll 240 may be guided to an intermediate-pressure chamber via a pocket groove 314. For reference, the oil discharged through the first oil supply hole 234*a* or the third oil supply hole 234*d* as well as the second oil supply hole 234*b* may be supplied to the pocket groove 314.

In one example, the oil guided along the rotating shaft 230 may be supplied to the Oldham's ring 340 and the fixed side plate 322 of and the fixed scroll 320 installed between the orbiting scroll 240 and the main frame 310. Therefore, wear of the fixed side plate 322 of the fixed scroll 320 and the Oldham's ring 340 may be reduced. In addition, the oil supplied to the third oil supply hole 234*c* may be supplied to the compression chamber so as to not only reduce the wear caused by friction between the orbiting scroll 330 and the fixed scroll 320, but also improve a compression efficiency by forming the oil film and dissipating the heat.

A centrifugal oil supply structure in which the lower scroll compressor 10 supplies the oil to the bearing using the rotation of the rotating shaft 230 has been described, but this is only one embodiment. In one example, a differential pressure oil supply structure that supplies the oil using the pressure difference inside the compressing portion 300 and a forced oil supply structure that supplies the oil via a trochoid pump or the like may be applied.

In one example, the compressed refrigerant is discharged to the discharge hole 326 along a space defined by the fixed wrap 323 and the orbiting wrap 333. It may be more advantageous that the discharge hole 326 is defined to face the discharge portion 121. This is because it is most advantageous for the refrigerant discharged from the discharge hole 326 to be delivered to the discharge portion 121 without a significant change in a flow direction.

However, because of the structural characteristics that the compressing portion 300 is disposed on the side of the driver 200 far from the discharge portion 121 and the fixed scroll 320 is disposed at an outermost portion of the compressing portion 300, the discharge hole 326 is defined to spray the refrigerant in a direction opposite to the discharge portion 121.

In other words, the discharge hole 326 is defined to spray the refrigerant in a direction away from the discharge portion 121 from the fixed end plate 321. Therefore, when the refrigerant is directly sprayed into the discharge hole 326, the refrigerant may not be smoothly discharged to the discharge portion 121, and when the oil is stored in the blocking shell 130, there may be a fear that the refrigerant collides with the oil to be cooled or mixed with the oil.

To prevent such problem, the compressor 10 according to the present disclosure may further include the muffler 500 coupled to an outermost portion of the fixed scroll 320 to provide a space for guiding the refrigerant to the discharge portion 121.

The muffler 500 may be provided to seal one surface of the fixed scroll 320 at a side far from the discharge portion 121 so as to guide the refrigerant discharged from the fixed scroll 320 to the discharge portion 121.

The muffler 500 may include a coupled body 520 coupled to the fixed scroll 320 and an accommodating body 510 extending from the coupled body 520 so as to define a closed space. Accordingly, the refrigerant sprayed from the discharge hole 326 may be discharged to the discharge portion 121 by changing the flow direction along the closed space defined by the muffler 500.

In one example, because the fixed scroll 320 is coupled to the accommodating shell 110, the refrigerant may be restricted from flowing to the discharge portion 121 by being interrupted by the fixed scroll 320. Accordingly, the fixed scroll 320 may further include a bypass hole 327 through which the refrigerant may pass through the fixed scroll 320 by passing through the fixed end plate 321. The bypass hole 327 may be defined to be in communication with the main hole 327. As a result, the refrigerant may pass through the compressing portion 300, then pass through the driver 200, and then be discharged through the discharge portion 121.

In one example, the refrigerant is compressed with a higher pressure inwardly from the outer circumferential surface of the fixed wrap 323, so that regions inside the fixed wrap 323 and the orbiting wrap 333 maintain a high-pressure state. Therefore, the discharge pressure acts on a rear surface of the orbiting scroll as it is, and a back pressure acts from the orbiting scroll toward the fixed scroll as a reaction. The compressor 10 according to the present disclosure may further include a back pressure seal 350 that allows the back pressure to be concentrated in a portion where the orbiting scroll 330 and the rotating shaft 230 are coupled to each other so as to prevent leakage between the orbiting wrap 333 and the fixed wrap 323.

The back pressure seal 350 may be formed in a ring shape so as to maintain an inner circumferential surface thereof at a high-pressure and separate an outer circumferential surface thereof at an intermediate-pressure lower than the high-pressure. Therefore, the back pressure is concentrated on the inner circumferential surface of the back pressure seal 350, so that the orbiting scroll 330 is brought into close contact with the fixed scroll 320.

In consideration of the discharge hole 326 being spaced apart from the rotating shaft 230, the back pressure seal 350 may also be disposed such that a center thereof is biased toward the discharge hole 326. In addition, because of the back pressure seal 350, the oil supplied from the first oil supply hole 234*a* may be supplied to the inner circumferential surface of the back pressure seal 350. Accordingly, the oil may lubricate contact surfaces of the fixed scroll and the orbiting scroll. Furthermore, the oil supplied to the inner circumferential surface of the back pressure seal 350 may form a back pressure for pushing the orbiting scroll 330 to the fixed scroll 320 together with a portion of the refrigerant.

Accordingly, a compression space of the fixed wrap 323 and the orbiting wrap 333 may be divided into the high-pressure region S1 of an inner region of the back pressure seal 350 and the intermediate-pressure region V1 of an external region of the back pressure seal 350 based on the back pressure seal 350. In one example, because the pressure increases while the refrigerant is introduced and compressed, the high-pressure region S1 and the intermediate-pressure region V1 may be naturally distinguished from each other. However, because a pressure change may critically occur because of the presence of the back pressure seal 350, the compression space may be divided by the back pressure seal 350.

In one example, the oil supplied to the compressing portion 300 or the oil stored in the casing 100 may flow together with the refrigerant as the refrigerant is discharged to the discharge portion 121. In this regard, the oil is denser than the refrigerant, so that the oil is not able to flow to the discharge portion 121 due to a centrifugal force generated by the rotor 220, and is attached to inner walls of the discharge shell 120 and the accommodating shell 110. In the scroll compressor 10, the driver 200 and the compressing portion 300 may further include recovery passages on outer circumferential surfaces thereof so as to recover the oil attached to the inner wall of the casing 100 to the oil storage space of the casing 100 or the blocking shell 130, respectively.

The recovery passages may include a driver recovery passage 201 defined in the outer circumferential surface of the driver 200, a compressing portion recovery passage 301 defined in the outer circumferential surface of the compressing portion 300, and a muffler recovery passage 501 defined in the outer circumferential surface of the muffler 500.

The driver recovery passage 201 may be defined as a portion of an outer circumferential surface of the stator 210 is recessed, and the compressing portion recovery passage 301 may be defined as a portion of the outer circumferential surface of the fixed scroll 320 is recessed. In addition, the muffler recovery passage 501 may be defined as a portion of the outer circumferential surface of the muffler is recessed. The driver recovery passage 201, the compressing portion recovery passage 301, and the muffler recovery passage 501 may be in communication with each other to allow the oil to pass therethrough.

As described above, because the center of gravity of the rotating shaft 230 is biased to one side because of the eccentric shaft 232*b*, an unbalanced eccentric moment may occur during the rotation of the rotating shaft 230, and thus overall balance may be disturbed. Accordingly, the scroll compressor 10 according to the present disclosure may further include a balancer 400 capable of offsetting an eccentric moment that may occur by the eccentric shaft 232*b*.

Because the compressing portion 300 is fixed to the casing 100, the balancer 400 is preferably coupled to the rotating shaft 230 itself or the rotor 220 provided to rotate. Therefore, the balancer 400 may include a center balancer 410 disposed on a lower end of the rotor 220 or one surface of the rotor 220 facing the compressing portion 300 so as to offset or reduce an eccentric load of the eccentric shaft 232*b*, and an outer balancer 420 coupled to an upper end of the rotor 220 or the other surface of the rotor 220 facing the discharge portion 121 so as to offset an eccentric load or an eccentric moment of at least one of the eccentric shaft 232*b* and the lower balancer 420.

Because the center balancer 410 is disposed relatively close to the eccentric shaft 232*b*, the center balancer 410 may directly offset the eccentric load of the eccentric shaft 232*b*. Therefore, it is preferable that the center balancer 410 is eccentric in a direction opposite to the eccentric shaft 232*b*. As a result, even when the rotating shaft 230 rotates at a low speed or a high speed, because a spaced distance from the eccentric shaft 232*b* is small, the center balancer 410 may effectively offset the eccentric force or the eccentric load generated from the eccentric shaft 232*b* almost uniformly.

The outer balancer 420 may be eccentric in a direction opposite to the direction in which the eccentric shaft 232*b* is eccentric. However, the outer balancer 420 may be eccentric in a direction corresponding to the eccentric shaft 232*b* to partially offset the eccentric load generated by the center balancer 410.

Accordingly, the center balancer 410 and the outer balancer 420 may offset the eccentric moment generated by the eccentric shaft 232*b* to assist the rotating shaft 230 to rotate stably.

Figure 3:
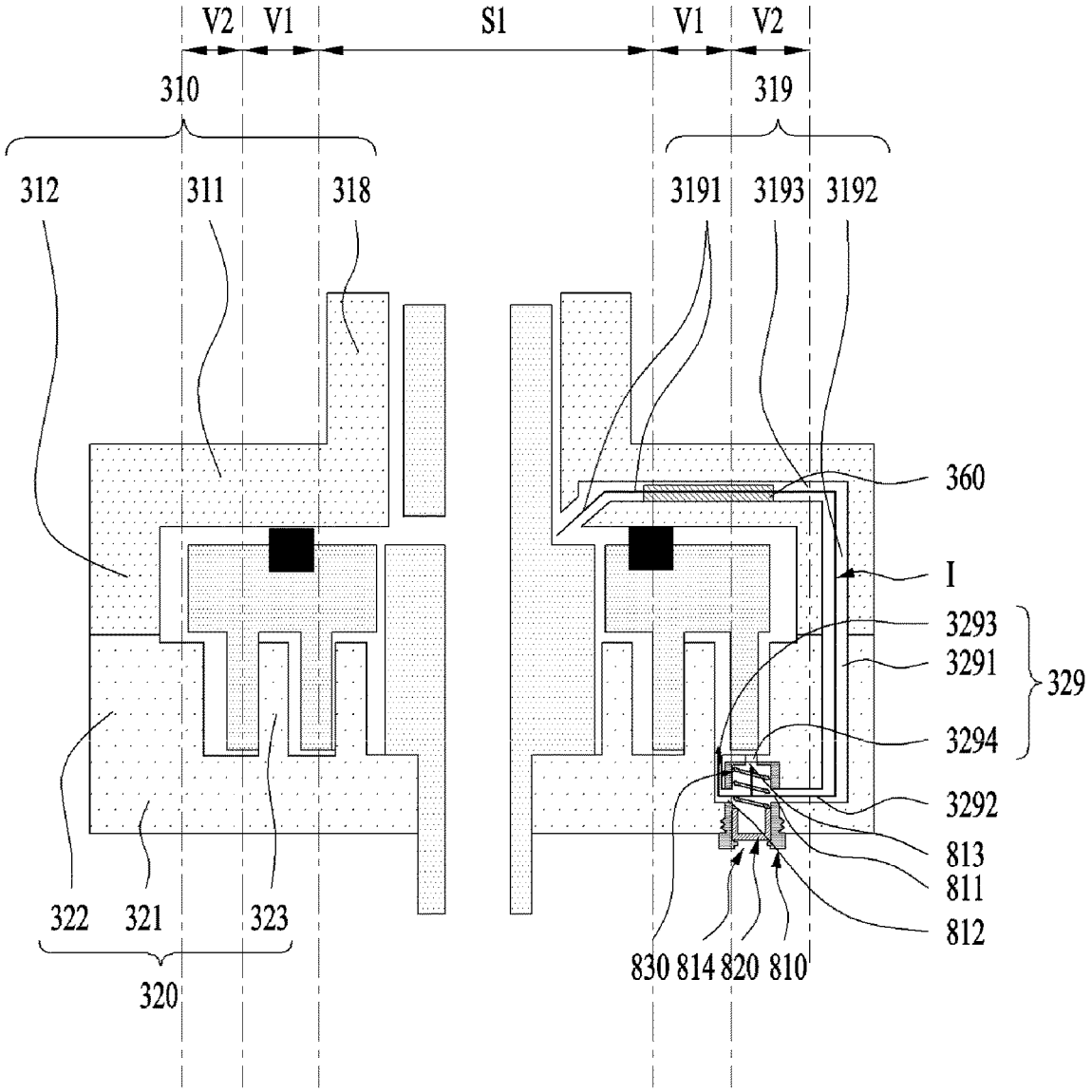
FIG. 3 shows an oil supply passage structure of a compressor according to the present disclosure.

FIG. 3 shows an oil supply passage structure of a compressor according to the present disclosure.

The compressor according to the present disclosure may include an oil supply passage I for supplying the oil delivered from the rotating shaft through the orbiting end plate or the fixed end plate to the space between the orbiting wrap and the fixed wrap.

When the oil supply passage I is defined through the fixed end plate 321, the oil supply passage I may also extend through the main frame 310.

Specifically, the oil supply passage I may include a delivery passage 319 defined through the main frame 310 and a fixed passage 329 defined through the fixed scroll 320.

The oil supply passage I may include the delivery passage 319 defined in the fixed scroll 310 and to which the oil supplied from the supply passage 234 flows, and the fixed passage 329 defined in the fixed scroll to be in communication with the delivery passage so as to supply the oil to the space between the orbiting scroll 330 and the fixed scroll 310.

The delivery passage 319 may be installed in the main frame 310 fixed to the casing 100, and the fixed passage 329 may also be installed in the fixed scroll 320 fixed to the casing 100. As a result, the oil supply passage I may always be fixed without changing in the position even when the orbiting scroll 330 moves. Accordingly, the oil may stably flow via the delivery passage 319 and the fixed passage 329, and an amount of supplied oil may be easily controlled.

The delivery passage 319 may include a main passage 3191 supplied with the oil through the main shaft accommodating portion 318, a passing passage 3192 extending from the main passage 3191 toward the outer circumferential surface along the main end plate 311 and through which the oil passes, and a discharge passage 3193 connected to a distal end of the passing passage 3192 and extending toward the fixed scroll 320 to discharge the oil.

The main passage 3191 may be defined separately from a space between the main end plate 311 of the main frame and the orbiting end plate 331 of the orbiting scroll. Accordingly, the oil discharged from the second oil supply hole 234*b* may be introduced into the space between the main end plate 311 and the orbiting end plate 331 so as to be supplied to the back pressure seal 350, and may also be introduced into the main passage 3191 at the same time.

In one example, the fixed passage 329 may include an inflow passage 3291 defined inside the fixed side plate 322 so as to be in communication with the discharge passage 3193 and into which the oil supplied to the delivery passage 319 flows, and a flow passage 3292 defined so as to be in communication with the inflow passage 3291 at a location inside the fixed end plate and allowing the oil to be supplied to the inflow passage to flow to the fixed wrap 323.

In this regard, the fixed passage 329 must supply the oil to at least the outer circumferential surface of the fixed wrap 323, so that the inlet passage 3291 may extend to have a length corresponding to or greater than a thickness of the fixed wrap 323 in the fixed side plate 322.

The flow passage 3292 may extend from the inflow passage 3291 toward the rotating shaft 230, and may extend to an outermost inner circumferential surface of the fixed wrap 323.

In one example, the back pressure seal 350 may be installed inside the Oldham's ring 340, and may prevent an entirety of the oil supplied from the rotating shaft 230 from leaking directly to the space between the main frame 310 and the orbiting scroll 330. The back pressure seal 350 may serve to induce the oil introduced from the rotating shaft 230 to be transferred to the main passage 3191.

Because the main passage 3191 corresponding to an entrance of the delivery passage 319 is located in the high-pressure region S1 and the fixed passage 329 is in communication with the intermediate-pressure region V1 or the low-pressure region V2, the oil supplied from the first oil supply hole 234*a* may be delivered to the fixed passage 329 while flowing into the delivery passage 319 because of the pressure difference. Accordingly, the oil may be delivered to the fixed wrap 323 to lubricate the orbiting wrap 333 and the fixed wrap 323.

In one example, when the compressor 10 according to the present disclosure is driven at a pressure ratio higher than a low pressure ratio, the pressure difference between the high-pressure region S1 and the intermediate-pressure region V1 may become very great, and the oil may be excessively supplied to the fixed wrap 323 and the orbiting wrap 333. Accordingly, a large amount of oil may be diluted in the introduced refrigerant, the fixed wrap 323 and the orbiting wrap 333 may be cooled by the oil, or the oil supply to the fixed wrap 323 may be stopped.

In order to prevent such problem, in the compressor according to an embodiment of the present disclosure, decompressing portion 360 capable of reducing the pressure difference between the high-pressure region and the low-pressure region may be installed in the delivery passage 319 or the fixed passage 329.

The decompressing portion 360 may be inserted into the delivery passage or the fixed passage so as to increase a passage resistance by reducing a diameter of the passage. In addition, the decompressing portion 360 may increase the passage resistance by maximizing a frictional force with respect to the oil. Accordingly, the pressure difference between the high-pressure region S1 and the intermediate-pressure region V1 may be partially compensated for by the decompressing portion 360 so as to prevent the excessive supply of the oil to the fixed wrap 323 and the orbiting wrap 333.

Because the decompressing portion 360 must be installed by being inserted into the delivery passage or the fixed passage, the main frame 310 or the fixed scroll 320 may further include an insertion hole defined therein in communication with the outside of the compressing portion 300 such that the decompressing portion 360 is inserted thereinto.

In one example, the compressor 10 according to the present disclosure may include a first passage 3293 defined to supply the oil delivered via the oil supply passage I to the space between the fixed wrap 323 and the orbiting wrap 333, and a second passage 3294 spaced farther away from the rotating shaft 230 than the first passage 3293 and disposed in the space between the fixed wrap 323 and the orbiting wrap 333.

The first passage 3293 may extend through the fixed end plate 321 so as to supply the oil to the compression chamber formed by the fixed wrap 323 and the orbiting wrap 333.

The second passage 3294 may extend through the fixed end plate 321, but may be defined at a position spaced farther away from the rotating shaft 230 than the first passage 3293 to supply the oil. A portion of the oil supplied from the flow passage 3292 may be supplied to the first passage 3239 and the remaining portion thereof may be supplied to the second passage 3294.

For example, the first passage 3293 may be defined to supply the oil to the intermediate-pressure region V1, and the second passage 3294 may be defined to supply the oil to the low-pressure region V2. In this regard, the second passage 3294 may be defined as close to the suction hole 325 as possible so as to secure a pressure difference from the supply passage 234 defined in the rotating shaft 230.

In other words, the first passage 3293 may be defined to supply the oil to the intermediate-pressure region V1, and the second passage 3294 may be arranged to supply oil to the low-pressure region V2. The second passage 3294 may be defined closer to the suction hole 325 than the first passage 3293.

Accordingly, when the compressor according to the present disclosure is driven at the low pressure ratio such as a ratio of a discharge pressure and a suction pressure from 1.1 to 1.3, the oil may be supplied to the low-pressure region V2 via the second passage 3294. In addition, when the compressor according to the present disclosure is driven at the pressure ratio higher than the low pressure ratio, the oil may be supplied to the intermediate-pressure region V1 via the first passage 3293.

The oil supply passage I is defined to supply the oil to at least one of the first passage 3293 and the second passage 3294. Accordingly, the oil may be supplied to both the intermediate-pressure region V1 and the low-pressure region V2 via the oil supply passage I. Accordingly, even when the single oil supply passage I is defined, the compressor 10 according to the present disclosure may supply the oil to both the intermediate-pressure region V1 and the low-pressure region V2. As a result, a structure and a manufacturing process of the compressing portion 300 may be simplified.

In one example, when the compressor according to the present disclosure is driven at a low pressure ratio, a pressure in the intermediate-pressure region V1 in which the first passage 3293 is defined has relatively no difference from the discharge pressure, so that, even when the first passage 3293 is not sealed, the oil may not be excessively supplied to the first passage 3293, or the oil supply itself may not be performed.

However, when the compressor according to the present disclosure is driven at the pressure ratio higher than the low pressure ratio, because the second passage 3294 is located in a region where a pressure is lower than that of a region of the first passage 3293, the oil may also be supplied to the second passage 3294. Therefore, when the compressor according to the present disclosure is driven at the pressure ratio higher than the low pressure ratio, the oil may be excessively supplied to the compressing portion 300, so that the efficiency of the compressor may decrease, or the leakage of the oil may occur.

In order to prevent such problem, the compressor according to the present disclosure may include adjusting portion 800 disposed to be in communication with all of the oil supply passage I, the first passage 3293, and the second passage 3294 and determining to supply the oil to at least one of the first passage 3293 and the second passage 3294.

The adjusting portion 800 may be disposed to be in communication with both the first passage 3293 and the second passage 3294 as well as to be in communication with the oil supply passage I. Furthermore, the adjusting portion 800 may be provided to selectively open and close the first passage 3293 and the second passage 3294.

Accordingly, the compressor 10 according to the present disclosure may supply the oil supplied from the oil supply passage I to the first passage 3293 and the second passage 3294 via one adjusting portion 800. In addition, via the one adjusting portion 800, amounts of oil to be supplied to the first passage 3293 and the second passage 3294 may be adjusted or oil supply to a specific passage among the first passage 3293 and the second passage 3294 may be blocked.

For example, the adjusting portion 800 may be controlled to open the second passage 3294 in the low pressure ratio driving such that the oil is sufficiently supplied to the low-pressure region V2. The adjusting portion 800 may be controlled to open the first passage 3293 and selectively open the second passage 3294 while being driven at the pressure ratio higher than the low pressure ratio so as to supply the oil to the intermediate-pressure region V1, but to prevent excessive supply of the oil.

When the compressing portion 300 is operated by the driver 200, the inside of the casing 100 becomes in a high-temperature and high-pressure state because of the refrigerant discharged from the compressing portion 300, so that it is not preferable that the adjusting portion 800 is electronically controlled.

Accordingly, in the compressor 10 according to the present disclosure, the adjusting portion 800 may be provided to selectively open and close one of the first passage 3293 and the second passage 3294 mechanically based on the internal pressure of the casing.

The adjusting portion 800 may be provided to open the second passage 3294 based on a low-pressure state inside the casing 100 when the compressor 10 is driven at the low pressure ratio.

The adjusting portion 800 may be provided to open both the first passage 3293 and the second passage 3294 or close the first passage 3293 based on the pressure state inside the casing 100 when the compressor 10 is driven at a pressure ratio equal to or higher than the low pressure ratio.

As a result, the adjusting portion 800 may be provided such that opened and closed states of the first passage 3293 and the second passage 3294 may be immediately and manually determined by a pressure of the refrigerant discharged when the compressor 10 is driven at the low pressure ratio or the pressure ratio higher than the low pressure ratio.

The pressure inside the casing is almost equal to the pressure of the refrigerant discharged from the discharge hole 326 of the fixed scroll 320. Accordingly, the adjusting portion 800 may include a shielding portion 820 that selectively opens and closes one of the first passage 3293 and the second passage 3294 based on the pressure of the refrigerant discharged from the discharge hole 326.

The second passage 3294 needs to be opened because the oil needs to be supplied to the low-pressure region V2 in the low pressure ratio driving, but needs to be closed in order to block excessive oil supply to the low-pressure region V2 in the high pressure ratio driving.

Accordingly, the shielding portion 820 may be provided to selectively open and close the second passage 3294 in the fixed end plate 321 based on the pressure inside the casing.

That is, the shielding portion 820 may be provided to open the second passage 3294 when the compression portion 300 is driven at the low pressure ratio and the pressure of the casing is low, and may be provided to close the second passage 3294 when the compressing portion 300 is driven at the high pressure ratio and the pressure inside the casing is high.

To this end, the shielding portion 820 may be provided to reciprocate to be closer to or to be away from the second passage 3294 based on the pressure inside the casing 100, and may be provided to become closer to the second passage 3294 as the pressure inside the casing 100 increases.

The adjusting portion 800 may include an elastic portion 830 capable of returning the shielding portion 820 to an original position thereof. The elastic portion 830 may be mounted on one end of the shielding portion 820 to provide a restoring force such that the shielding portion 820 is spaced apart from the second passage 3294.

Accordingly, when the pressure inside the casing acts on the shielding portion 820, the elastic portion 830 may start to be compressed by the shielding portion 820. The elastic portion 830 may have an elastic modulus so as to be compressed at the pressure ratio equal to or higher than the low pressure ratio. Accordingly, the elastic portion 830 may prevent the shielding portion 820 from closing the second passage 3294 at a pressure corresponding to the low pressure ratio.

The elastic portion 830 may be formed as a leaf spring or the like, but may be formed in a general spring shape so as not to obstruct the flow of the oil.

In one example, the adjusting portion 800 may further include a housing 810 that is coupled to the fixed end plate 321 to accommodate therein the shielding portion 820 in a reciprocable manner, and is in communication with the first passage 3293, the second passage 3294, and the fixed passage 329.

The housing 810 may be installed such that at least a portion thereof is inserted into the fixed end plate 321, and may be press-fitted into the fixed end plate 321 or fixed in a manner such as welding.

The housing 810 may define therein a space in which the shielding portion 820 may reciprocate and the elastic portion 830 may be accommodated.

The housing 810 may be provided such that the remaining portion thereof is exposed toward the muffler 500 or the oil storage space from the fixed end plate 321. The housing 810 may be installed on one surface of the fixed end plate 321 in which the discharge hole 326 is defined, and may be coupled to the fixed end plate 321 at a side of the fixed end plate 321 far from the discharge portion 121.

The housing 810 may include an acting portion 814 formed as an open surface so as to transmit the refrigerant discharged from the discharge hole 326 or the pressure inside the casing 100 to the shielding portion 820. The acting portion 814 may be provided to be selectively closed by the shielding portion 820.

The shielding portion 820 may have a diameter equal to that of an inner circumferential surface of the housing 810, so that an installation direction or an installation position of the shielding portion 820 may be prevented from changing while the shielding portion 820 reciprocates the housing 810.

The housing 810 may be made of a material equal to that of the fixed scroll 320, may be made of a material with a higher rigidity or heat resistance than that of the fixed scroll 320, and may be made of a material having a small coefficient of expansion depending on a temperature.

The housing 810 may include an oil supply portion 811 spaced apart from the acting portion and in communication with the fixed passage 329 so as to deliver the oil into the housing, a first supply portion 812 separated from the acting portion 814 and the oil supply portion 811 and provided to deliver the oil to the first passage 3293, and a second supply portion 813 separated from the acting portion 814 and the oil supply portion 811 and provided to deliver the oil to the second passage 3294.

The housing 810 may be located adjacent to the suction hole 325, and may be disposed at a position corresponding to the fixed wrap 323 or the orbiting wrap 333 to which the suction hole 325 is adjacent.

The oil supply portion 811 may be disposed to be in communication with a distal end of the flow passage 3292, so that the housing 810 may be disposed closer to the rotating shaft 230 than the distal end of the flow passage 3292. Accordingly, the adjusting portion 800 itself may be disposed closer to the rotating shaft 230 than the fixed side plate 322, thereby being installed closer to the compression chamber in which the fixed wrap 323 is disposed.

The oil supply portion 811 may be disposed at a position spaced apart from the shielding portion 820 and opened when the shielding portion 820 closes the acting portion 814 or before the elastic portion 830 is compressed.

Accordingly, when the low-pressure is applied to the shielding portion 820, the oil supply portion 811 and the second supply portion 813 may be in communication with each other.

The second supply portion 813 may be disposed adjacent to the second passage 3294. The second supply portion 813 may be disposed at a position adjacent to the suction hole 325, and may be disposed at a position spaced apart from the second passage 3294 in the axial direction, thereby minimizing lengths of the second supply portion 813 and an entire passage of the second passage 3294. Accordingly, sufficient oil may be supplied to the second passage 3294 even in the low-pressure state as a passage resistance between the second supply portion 813 and the second passage 3294 is minimized.

The second passage 3294 may be defined to face the acting portion 814, and the shielding portion 820 may be provided to reciprocate between the second passage 3294 and the acting portion 814.

The first supply portion 812 may be disposed at a position facing the oil supply portion 811 of the housing 810. The first supply portion 812 may be disposed on one surface of the housing 810 facing the rotating shaft 230 to be disposed adjacent to the first passage 3293 defined in the intermediate-pressure region V2.

Figure 4:
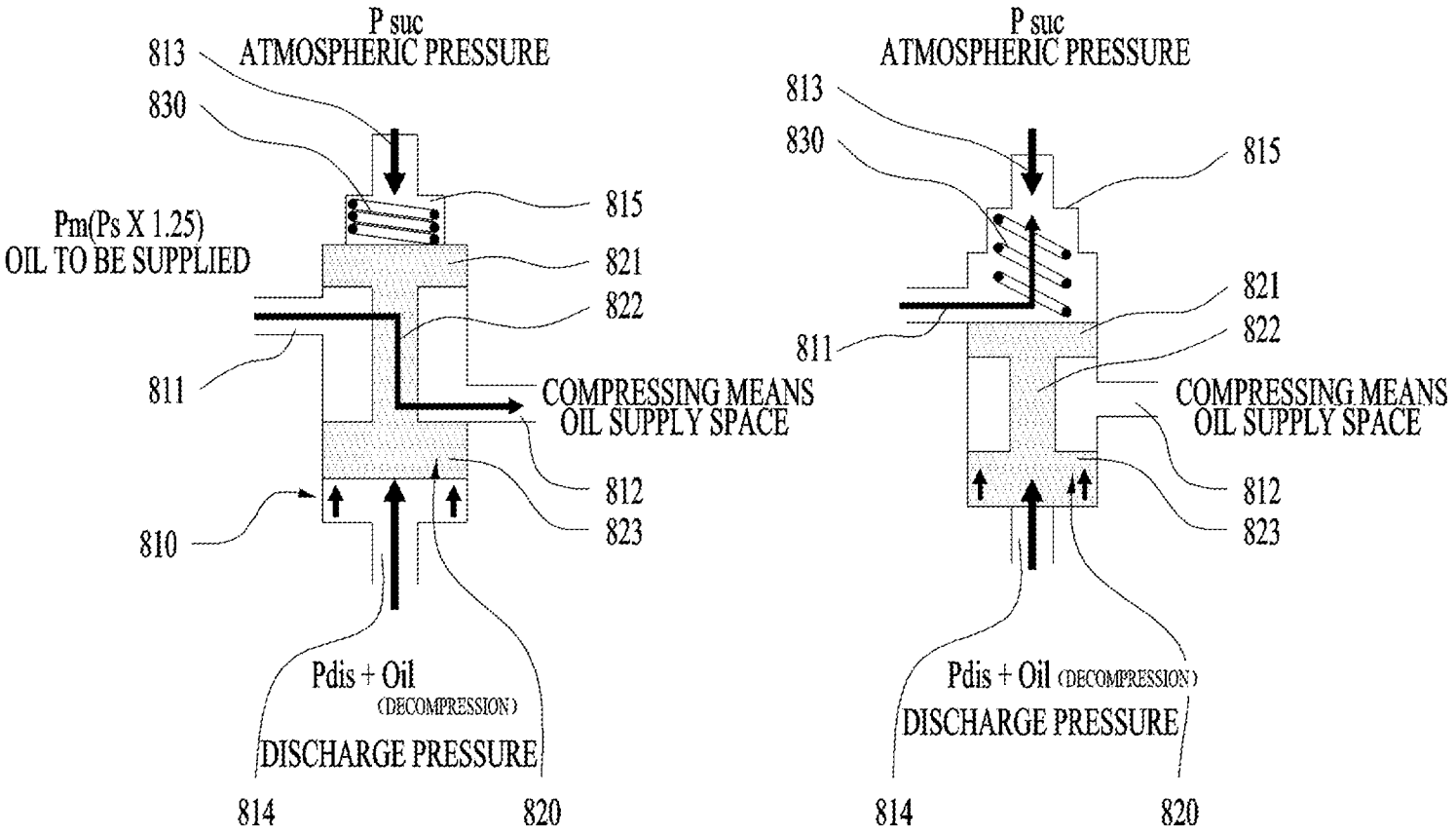
FIG. 4 shows a detailed embodiment of an oil supply passage structure according to the present disclosure.

FIG. 4 shows a detailed structure of the housing 810 in the adjusting portion 800.

Referring to (a) in FIG. 4, the housing 810 may be formed in a casing shape or a cylindrical shape, and the oil supply portion 811, the first supply portion 812, and the second supply portion 813 may be formed in a shape of a pipe in communication with the inside of the housing 810. The oil supply portion 811, the first supply portion 812, and the second supply portion 813 may be defined as holes extending through the housing 810, and may be in communication with the fixed passage 329, the first passage 3293, and the second passage 3294, respectively.

The acting portion 814 may be defined such that the housing 810 is in communication with the exposed surface or one surface facing the muffler 500 of the fixed scroll 320, and may be formed in a shape a pipe or a shape of a hole in communication with the exposed surface of the fixed scroll 320.

A diameter of the acting portion 814 is much greater than a diameter of the shielding portion 820, so that the shielding portion 820 may be prevented from deviating to the outside of the housing 810.

The second supply portion 813 may be formed to face the acting portion 814, and a distance between the second supply portion 813 and the acting portion 814 may be greater than a length of the shielding portion 820. The shielding portion 820 may be provided to move from the acting portion 814 to the second supply portion 813 and close the second supply portion 813 when a pressure equal to or greater than that of the low pressure ratio is received from the acting portion 814.

The elastic portion 830 may be disposed between one end of the shielding portion 820 and the second supply portion 813 so as to press the shielding portion 820 toward the acting portion 814. The elastic portion 830 may be compressed when the shielding portion 820 receives a reference pressure, and the elastic modulus of the elastic portion 830 may be a physical quantity that may be changed when the reference pressure is received. The reference pressure may correspond to a maximum pressure of the refrigerant discharged from the compressing portion 300 when the compressing portion 300 is driven at the low pressure ratio.

Accordingly, at a pressure equal to or lower than the reference pressure, the elastic portion 830 is not compressed or an amount of compression thereof is small, so that the shielding portion 820 may not close the second supply portion 813. As a result, in the low pressure ratio driving, the oil introduced into the oil supply portion 811 may be introduced into the second supply portion 813.

The housing 810 may include an accommodating step 815 having a larger diameter than the second supply portion 813 so as to accommodate therein one end of the elastic portion 830. An entrance of the second supply portion 813 may be defined in an inner circumferential surface of the accommodating step 815.

A diameter of the elastic portion 830 may be greater than that of the second supply portion 813. Accordingly, the elastic portion 830 may be prevented from being inserted into the second supply portion 813 by the shielding portion 820.

In addition, the diameter of the elastic portion 830 may be equal to or smaller than the diameter of the accommodating step 815. Accordingly, the elastic portion 830 may be mounted inside the accommodating step 815 and the arrangement thereof may be prevented from being arbitrarily changed.

The acting portion 814 may be disposed closest to one surface of the fixed scroll 320 facing the muffler 500 among the components of the housing 810, and the second supply portion 813 may be disposed closest to the fixed wrap 323 or the orbiting wrap 333 among the components of the housing 810.

The oil supply portion 811 may be disposed closer to the second supply portion 813 than the acting portion 814, and the first supply portion 812 may be disposed closer to the acting portion 814 than the second supply portion 813.

Accordingly, the oil introduced into the oil supply portion 811 may be delivered to the second supply portion 813 with the lowest resistance without being affected by the shielding portion 820 as much as possible.

In addition, a distance between the oil supply portion 811 and the first supply portion 812 may be relatively great, so that, when the compressing portion 300 compresses the refrigerant at the low pressure ratio, and thus, a distance at which the shielding portion 820 is spaced apart from the acting portion 814 is small, the oil supplied from the oil supply portion 811 may be prevented from being distributed toward the first supply portion 812.

The shielding portion 820 may include an opening/closing body 821 that reciprocates the housing 810 and selectively closes the oil supply portion 811 and the first supply portion 812, an extending body 822 extending from the opening/closing body 821 toward the acting portion 814, and a blocking body 823 extending from the extending body 822 and selectively closing the acting portion 814.

The opening/closing body 821 may be formed in a shape corresponding to that of a cross-section of the housing 810. An outer circumferential surface of the opening/closing body 821 may face the inner circumferential surface of the housing 810, and may be in surface contact with the inner circumferential surface of the housing 810.

The extending body 822 may have a diameter smaller than that of the opening/closing body 821 so as to prevent the shielding portion 820 from becoming excessively heavy and to serve as a passage through which the oil introduced from the oil supply portion 811 flows.

The blocking body 823 may have a diameter greater than that of the extending body 822, and may be in surface contact with the inner circumferential surface of the housing 810. The blocking body 823 and the inner circumferential surface of the housing 810 may be sealed with each other so as to block the refrigerant or the oil from flowing into the housing 810 via the acting portion 814.

In other words, the blocking body 823 may be in close contact with an inner wall of the housing 810 so as to block communication between the acting portion 814 and the first supply portion 812 or the second supply portion 813.

To this end, a sealing member for sealing the inner circumferential surface of the housing 810 may be additionally disposed on an outer circumferential surface of the blocking body 823.

In one example, a total length of the shielding portion 820 may be smaller than the length from the second supply portion 813 to the acting portion 814, and may also be smaller than the length from the oil supply portion 811 to the acting portion 814.

Specifically, a length of the extending body 822 may be greater than a distance between the oil supply portion 811 and the first supply portion 812 spaced apart from each other in the axial direction. However, the length of the extending body 822 may be smaller than the distance between the oil supply portion 811 and the acting portion 814.

The shielding portion 820 may selectively open and close the second passage 3294 inside the fixed end plate 321 based on the pressure inside the casing 100.

As shown in (a) in FIG. 4, when the pressure of the refrigerant discharged at the high pressure ratio acts on the acting portion 814, while the elastic portion 830 is compressed, the shielding portion 820 may close the second supply portion 813.

As shown in (b) in FIG. 4, when the pressure of the refrigerant discharged at the low pressure ratio acts on the acting portion 814 or the pressure does not act on the acting portion 814, the elastic portion 830 may be extended to push the shielding portion 820 toward the acting portion 814. Accordingly, the shielding portion 820 may open the second supply portion 813.

In one example, the first supply portion 812 may also be selectively opened by the shielding portion 820 while the shielding portion 820 reciprocates between the second supply portion 813 and the acting portion 814.

However, because the first supply portion 812 is in communication with the intermediate-pressure region V1, when the compressor 10 is driven at the low pressure ratio, it is difficult to supply the oil to the first supply portion 812 even when the first supply portion 812 is open. In addition, even when the compressor 10 is driven at the high pressure ratio, the oil must be supplied to the first supply portion 812, so that the first supply portion 812 must be opened.

Accordingly, the first supply portion 812 may always be opened while the shielding portion 820 reciprocates from the acting portion 814 to the second supply portion 813.

In addition, the first supply portion 812 may be provided such that at least a portion thereof is opened by the shielding portion 820 even when the shielding portion 820 completely closes the second supply portion 813.

The shielding portion 820 being completely in close contact with the second supply portion 813 means that the compressor is driven at a significant high-pressure, so that a significant pressure difference may occur between the first supply portion 812 and the oil supply portion 811. Accordingly, the first supply portion 812 may be partially closed by the shielding portion 820, so that a supply amount of the oil may be adjusted.

To this end, the extending body 822 may have a length capable of shielding only a portion of the first supply portion 812 when the opening/closing body 821 comes into contact with the second supply portion 813.

Figure 5:
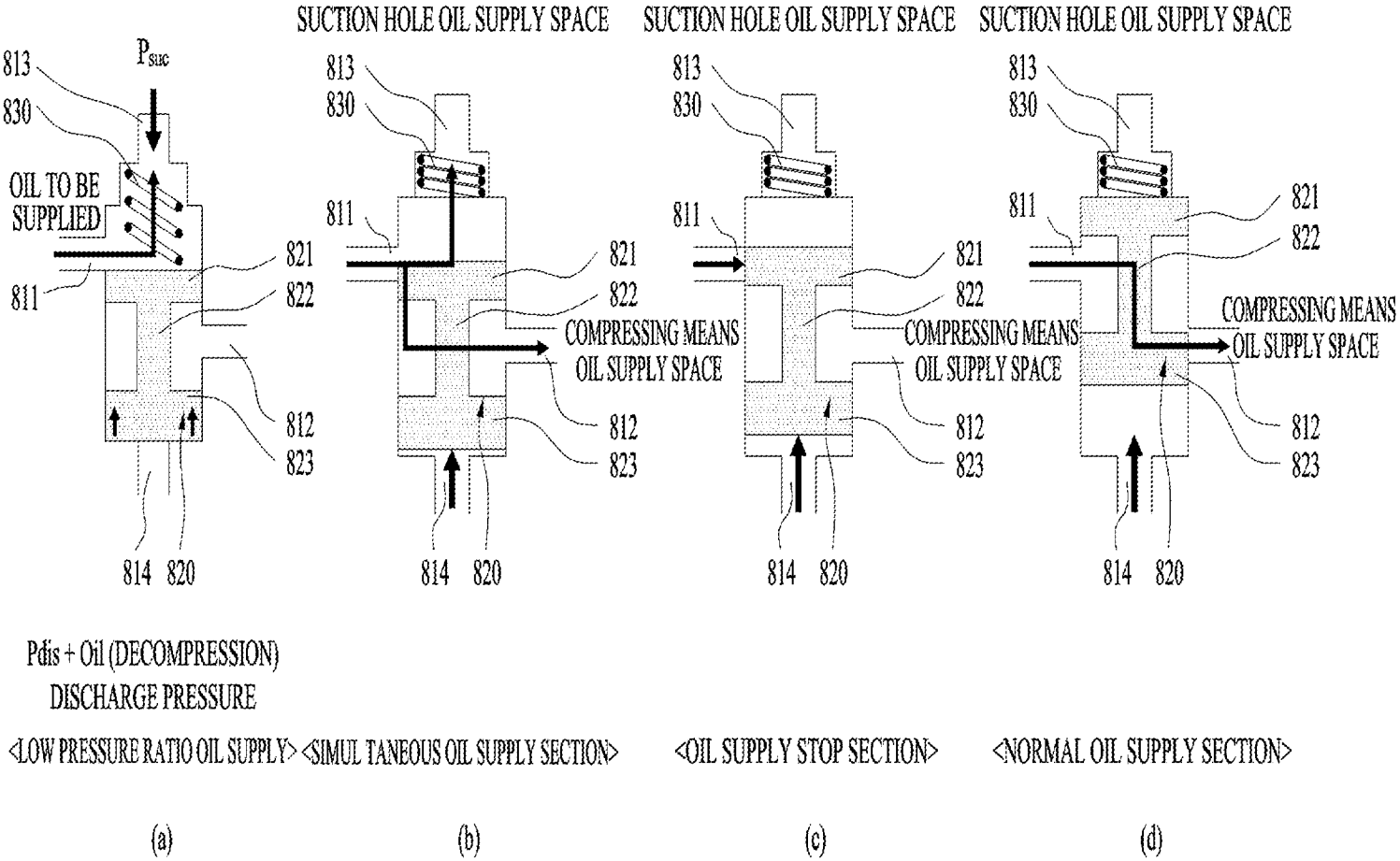
FIG. 5 shows an operating aspect of an oil supply passage structure in FIG. 4.

FIG. 5 shows an aspect in which the adjusting portion 800 according to the present disclosure operates.

When the refrigerant is discharged from the compressor 10, the discharged refrigerant may apply the pressure to the muffler 500. However, the discharged refrigerant exerts the pressure on an entirety of the inside of the casing 100 until being discharged to the discharge portion 121.

Therefore, regardless of the position of the housing 810, the discharged refrigerant may provide a pressure approximately equal to a discharge pressure to the acting portion 814 when the acting portion 814 is exposed to the outside of the fixed scroll 320.

Referring to (a) in FIG. 5, the compressor 10 may not operate or may be driven at the low pressure ratio of about 1.1 to 1.2, which is a pressure ratio of the sucked refrigerant to the discharged refrigerant. In this case, the blocking body 823 may be in close contact with the acting portion 814, and the opening/closing body 821 may be in a state of completely opening the oil supply portion 811 and the second supply portion 813.

Accordingly, the oil supplied to the oil supply portion 811 may be introduced into the housing 810 and then into the second supply portion 813 based on the pressure difference. In this regard, the oil may be restricted from flowing to the first supply portion 812 by the opening/closing body 821. However, because the opening/closing body 821 and the blocking body 823 are in communication with the first supply portion 812, the opening/closing body 821 and the blocking body 823 have a pressure greater than that of the second supply portion 813, so that the oil may be prevented from flowing toward the opening/closing body 821.

However, for more reliable sealing, a sealing member coupled to the outer circumferential surface of the opening/closing body 821 so as to seal the outer circumferential surface of the opening/closing body 821 and the inner circumferential surface of the housing 810 may be further disposed.

Referring to (b) in FIG. 5, the compressor 10 may be driven at the high pressure ratio exceeding 1.2. The refrigerant discharged at a relatively higher pressure than that of the low pressure ratio driving may apply the pressure to the acting portion 814.

The elastic portion 830 may start to be compressed because of having the elastic modulus so as to be compressed by the refrigerant discharged at the pressure ratio equal to or higher than the low pressure ratio.

When the elastic portion 830 is compressed, the shielding portion 820 may be spaced apart from the acting portion 814. However, because the discharge pressure is not great, the shielding portion 820 may not be able to close the second supply portion 813.

Accordingly, the oil discharged from the oil supply portion 811 may be directly supplied to the second supply portion 813. In addition, because the compressor 10 is driven at the pressure ratio equal to or higher than the low pressure ratio, a constant pressure difference may also occur between the oil supply portion 811 and the first supply portion 812. Accordingly, the oil supplied to the oil supply portion 811 may be supplied to the first supply portion 812 via the opening/closing body 821.

When the sealing member is installed on the outer circumferential surface of the opening/closing body 821, the oil of the oil supply portion 811 may flow toward the extending body 822 without interference from the sealing member when the sealing member is located on the inner circumferential surface of the oil supply portion 811.

Therefore, when the compressor 10 is driven at a pressure ratio higher than the low pressure ratio but relatively lower than the high pressure ratio, the adjusting portion 800 may supply the oil to both the first passage 3293 and the second passage 3294.

Referring to (c) in FIG. 5, the compressor 10 may compress and discharge the refrigerant at a higher pressure. That is, the compressor 10 may be driven with a higher output. In this case, the shielding portion 820 may be further spaced apart from the acting portion 814.

In this regard, the opening/closing body 821 may close at least a portion of the oil supply portion 811 while moving to the second supply portion 813. Accordingly, the supply of the oil to the second supply portion 813 may be stopped. In addition, as at least the portion of the oil supply portion 811 is closed, the supply of the oil to the first supply portion 812 may also be stopped.

As a result, when the compressing portion 300 is driven from the low pressure region to the high pressure region, the supply of the oil may be temporarily stopped. In such process, the oil supplied to the low-pressure region V2 via the second passage 3294 may wait to lubricate the entire compression chamber, and the communication between the second supply portion 813 and the oil supply portion 811 may be blocked before the second supply portion 813 is closed by the shielding portion 820.

Accordingly, as the pressure difference between the second passage 3294 and the oil supply portion 811 increases, the oil may be prevented from being excessively supplied via the second passage 3294.

Referring to (d) in FIG. 5, when the compressor 10 is driven at the high pressure ratio so as to further compress and discharge the refrigerant, the elastic portion 830 may be further compressed and the shielding portion 820 may completely close the second supply portion 813. In this regard, although the opening/closing body 821 is in close contact with the second supply portion 813 to close the second supply portion 813, the oil supply portion 811 may be opened.

The thickness of the opening/closing body 821 and the position of the oil supply portion 811 may be determined such that the oil supply portion 811 may be opened when the opening/closing body 821 is in close contact with the second supply portion 813.

When the opening/closing body 821 closes the second supply portion 813, the blocking body 823 may open at least a portion of the first supply portion 812. That is, the blocking body 823 may completely open the first supply portion 812, but may be provided to partially close the first supply portion 812.

The oil supply portion 811 and the first supply portion 812 may be in communication with each other to supply the oil to the first supply portion 812. In this regard, the blocking body 823 may close the portion of the first supply portion 812 to prevent the oil from being excessively supplied to the first supply portion 812.

As a result, when the shielding portion 820 blocks the communication between the second supply portion 813 and the oil supply portion 811, the adjusting portion 800 may allow the first supply portion 812 and the oil supply portion 811 to be in communication with each other. In addition, the adjusting portion 800 may allow a portion of the first supply portion 812 and the oil supply portion 811 to be in communication with each other when the second supply portion 813 is closed by being in contact with the shielding portion 820.

The length of the extending body 822 may be determined based on the installation positions of the oil supply portion 811 and the first supply portion 812 such that the adjusting portion 800 may perform the above-described function.

As a result, the adjusting portion 800 may selectively open and close the first passage 3293 and the second passage 3294 without separate electrical control depending only on the pressure of the discharged refrigerant.

Figure 6:
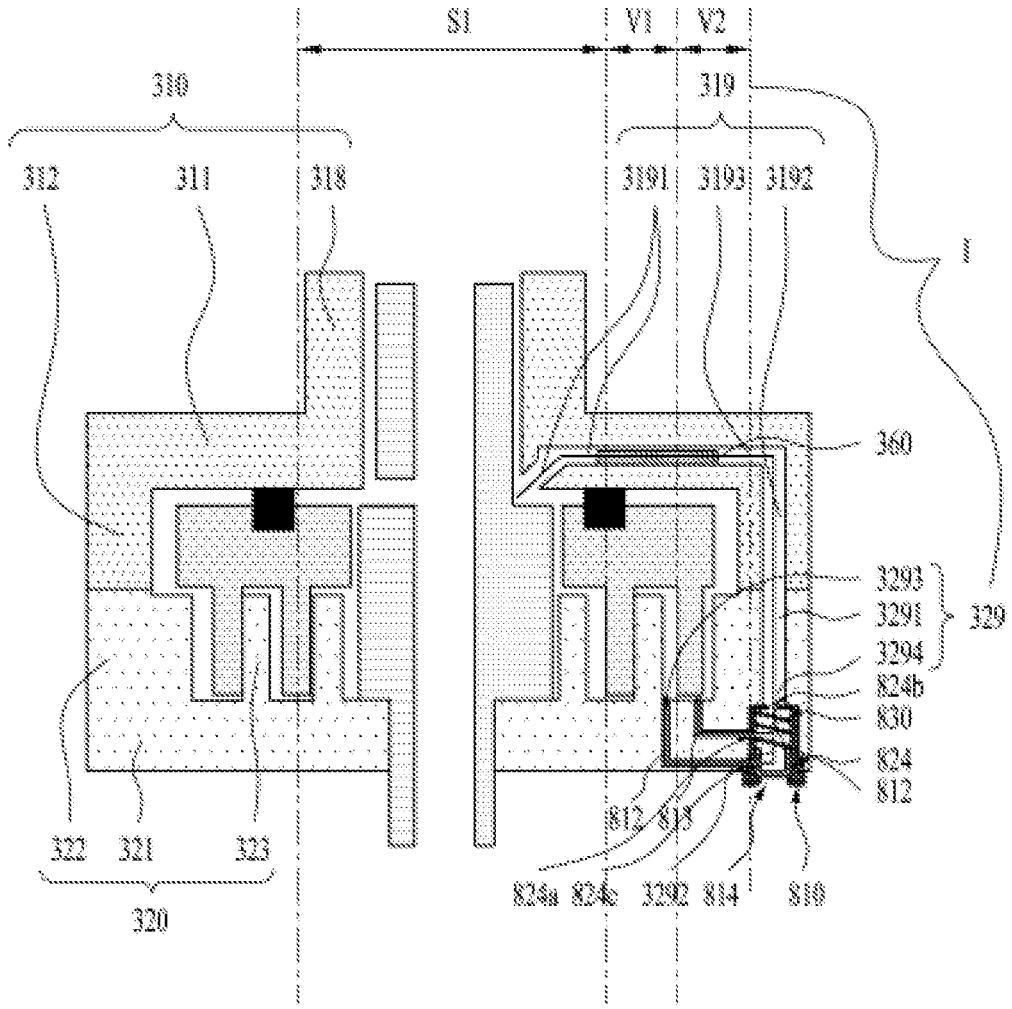
FIG. 6 shows another embodiment of an oil supply passage structure according to the present disclosure.

FIG. 6 shows another embodiment of the adjusting portion 800 according to the present disclosure. Hereinafter, a structure different from that of the adjusting portion in FIG. 3 will be mainly illustrated.

Referring to FIG. 6, the adjusting portion 800 may always remain in communication with the fixed passage 329. The adjusting portion 800 may be provided such that the fixed passage 329 is prevented from being sealed by the shielding portion 820 even when the shielding portion 820 moves based on the pressure.

Accordingly, the adjusting portion 800 may be continuously supplied with the oil via the rotating shaft without interruption.

In addition, the adjusting portion 800 may arrange both the first supply portion 812 and the second supply portion 813 in communication with the first passage 3293 and the second passage 3294 on a side surface of the housing 810, so that the flow direction of the oil introduced into the housing 810 may be maintained as much as possible.

Accordingly, the passage resistance is reduced inside the housing 810, and unnecessary vortex does not occur, so that the oil supply to the first supply portion 812 and the second supply portion 813 may become smoother.

Figure 7:
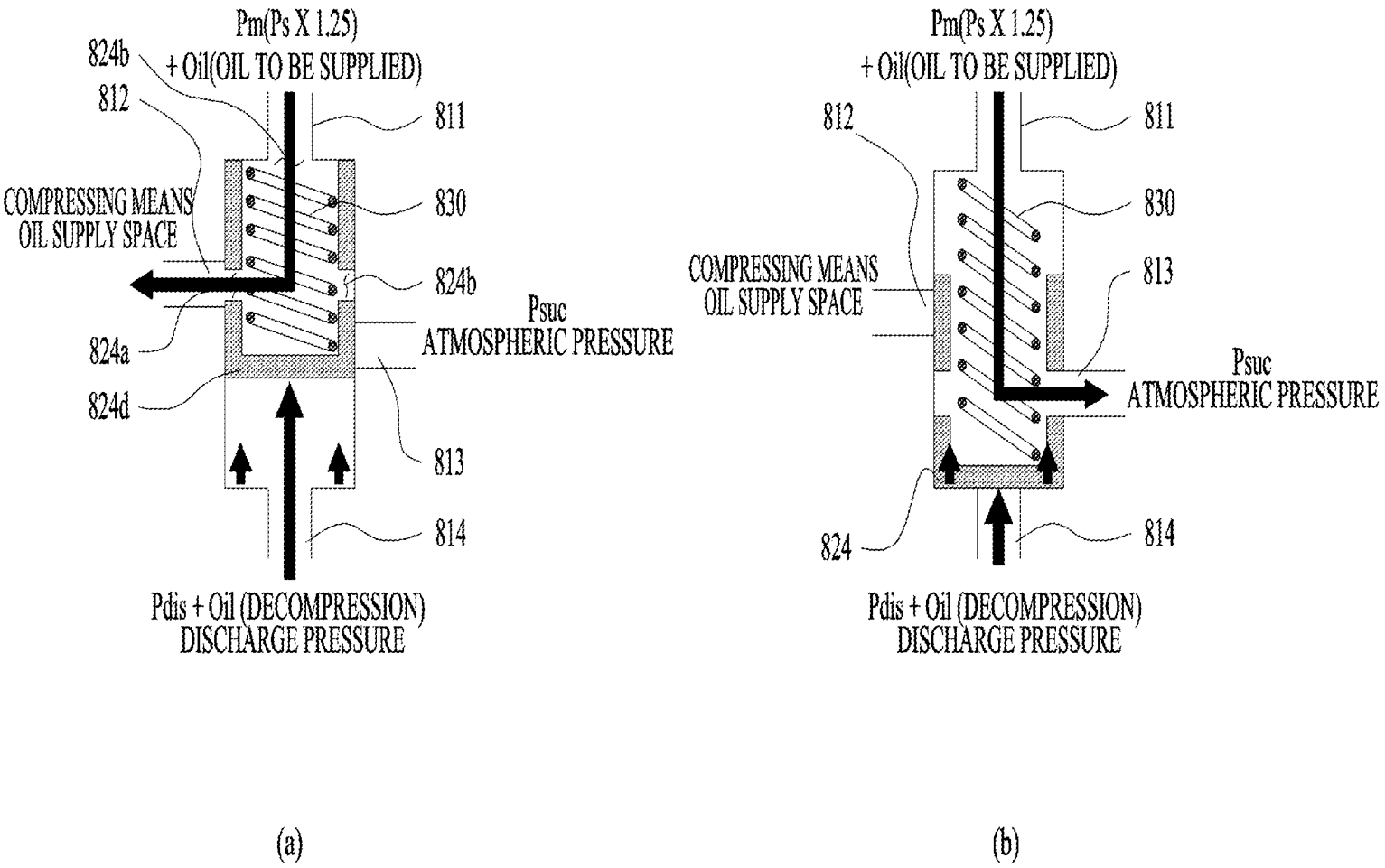
FIG. 7 is a view showing an operating aspect of an oil supply passage structure in FIG. 6.

FIG. 7 shows a detailed structure of the adjusting portion 800 in FIG. 6.

FIG. 6 shows that the first supply portion 812 and the second supply portion 813 are arranged on opposite sides with respect to the housing 810, but this is only for illustration. The first supply portion 812 and the second supply portion 813 may be arranged side by side or may be arranged to be spaced apart from each other at a certain angle with respect to the housing 810.

The adjusting portion 800 may be provided such that the acting portion 814 faces the oil supply portion 811 instead of the second supply portion 813 and the shielding portion 820 reciprocates between the acting portion 814 and the oil supply portion 811.

The housing 810 may include the acting portion 814 for transmitting the pressure inside the casing to the shielding portion 820, the oil supply portion 811 disposed to face the acting portion 814 and in communication with the fixed passage to deliver the oil into the housing, the first supply portion 812 separated from the acting portion 814 and the oil supply portion 811 and provided to deliver the oil to the first passage 3293, and the second supply portion 813 separated from the acting portion 814 and the oil supply portion 811 and provided to deliver the oil to the second passage 3294.

The acting portion 814 may have a diameter smaller than a width of the housing 810. The acting portion 841 may be formed in any shape as long as it may be exposed from the fixed scroll 320 toward the muffler 500 or the oil storage space.

The shielding portion 820 may be provided to selectively shield the first supply portion and the second supply portion while reciprocating between the acting portion 814 and the oil supply portion 811.

The adjusting portion 800 may include the elastic portion 830 accommodated in the housing 810 to push the shielding portion 820 toward the acting portion.

The shielding portion 820 may include a movable casing 824 for accommodating the elastic portion 830 therein. The movable casing 824 may be formed in a casing shape for accommodating therein the elastic portion 830, and the movable casing 824 may have a shape corresponding to a shape of the inner space of the housing 810.

For example, when a space in which the shielding portion 820 moves in the housing 810 is formed in a cylindrical shape, the movable casing 824 may also be formed in the cylindrical shape.

The movable casing 824 may be provided to reciprocate inside the housing 810 while in surface contact with the housing 810. In addition, the movable casing 824 may have a width corresponding to that of the inside of the housing 810 so as to be prevented from being misaligned in left and right directions inside the housing 810 even when not being in surface contact with the housing 810.

The movable casing 824 may include an open surface **824*b* for accommodating the elastic portion 830 therein, and a diameter of the open surface 824*b* may be equal to the diameter of the elastic portion 830 or may be slightly larger than the diameter of the elastic portion 830**.

The movable casing 824 may include a blocking surface **824*e* capable of sealing the acting portion 814 or selectively being in contact with the acting portion 814 at a portion facing the open surface 824*b*. A diameter of the blocking surface 824*e* may be larger than a diameter of the acting portion 814. Accordingly, the blocking surface 824***e* may be prevented from deviating to the outside of the acting portion 814.

The movable casing 824 may have a first communication hole 824*a* in communication with the first supply portion 812 and a second communication hole 824*c* in communication with the second supply portion 813 on an outer circumferential surface.

In the movable casing 824, the first communication hole 824*a* may have a size corresponding to the first supply portion 812, and the second communication hole 824*c* may have a size corresponding to the second supply portion 813.

Accordingly, even when the movable casing 824 moves by the size or the diameter of the first supply portion 812 or the second supply portion 813, the movable casing 824 may sufficiently close the first supply portion 812 or the second supply portion 813.

In one example, when the first supply portion 812 and the second supply portion 813 are disposed at different positions, the first communication hole 824*a* and the second communication hole 824*c* may be defined adjacent to the blocking surface 824*d*. Accordingly, the oil may be supplied to the first communication hole 824*a* and the second communication hole 824*c* without being stored unnecessarily on the blocking surface 824*d*.

The first communication hole 824*a* and the second communication hole 824*c* may be defined to be spaced apart from the blocking surface 824*d* by the same distance.

The first supply portion 812 may be disposed at a position capable of being in communication with the first communication hole 824*a* when the movable casing 824 is spaced apart from the acting portion 814, and the second supply portion 813 may be disposed at a position capable of being in communication with the second communication hole 824*c* when the movable casing 824 is disposed on the acting portion 814.

In one example, the second communication hole 824*c* is preferably defined to be spaced apart from the blocking surface 824*d* by the diameter of the second supply portion 813 at least. This is to prevent the acting portion 814 from being in communication with the second supply portion 813 when the movable casing 824 is moved to the oil supply portion 811 to the maximum.

A length of the movable casing 824 may be equal to or greater than a length from the oil supply portion 811 to an outer surface of the second supply portion 813 close to the acting portion 814.

The movable casing 824 may be provided to be in surface contact with the housing 810 such that the refrigerant or the oil introduced from the acting portion 814 from flowing into the housing 810, or may further include the sealing member provided to seal the inner surface of the housing 810 on the outer surface thereof adjacent to the blocking surface 824*d*.

The first supply portion 812 may be disposed farther from the acting portion 814 than the second supply portion 813. Accordingly, when the shielding portion 820 is spaced apart from the acting portion 814, the second supply portion 813 may be quickly shielded by the shielding portion 820. Accordingly, the oil may be prevented from being excessively supplied to the second supply portion 813.

The movable casing 824 may be in communication with the oil supply portion 811 via the open surface 824*b*.

The movable casing 824 may be formed as a sealed container corresponding to the shape of the housing 810, may have the open surface 824*b* at one surface thereof facing the oil supply portion 811, and may have the first communication hole 824*a* and the second communication hole 824*c* extending through side surfaces thereof extending along the open surface 824*b*.

In one example, the oil supply portion 811 may have the width smaller than the width of the housing 810. The diameter of the oil supply portion 811 may be smaller than the diameter of the elastic portion 830, so that the elastic portion 830 may be prevented from being fitted into the oil supply portion 811 or deviating.

Referring to (b) in FIG. 7, when the compressing portion 300 operates, a differential pressure is generated between the supply passage 234 defined in the rotating shaft 230 and the housing 810, so that the oil may be supplied to the oil supply portion 811.

In this regard, the compressing portion 300 may be driven at the low pressure ratio and may compress and discharge the refrigerant having a relatively low pressure. Because the elastic portion 830 has an elastic modulus so as not to be compressed when the compressing portion 300 compresses the refrigerant at the low pressure ratio, the movable casing 824 may be disposed while being in contact with the acting portion 814 by the elastic portion 830. The second communication hole 824*c* may be in communication with the second supply portion 813 so as to discharge the oil introduced from the oil supply portion 811 to the second supply portion 813.

Accordingly, the oil may be sufficiently supplied to the low-pressure region V2.

Referring to (a) in FIG. 7, when the compressing portion 300 compresses and discharges the refrigerant of a pressure higher than that in the low pressure ratio driving, the pressure of the refrigerant may compress the elastic portion 830 via the acting portion 814.

As a result, as the movable casing 824 moves toward the oil supply portion 811, and the second communication hole 824*c* and the second supply portion 813 are blocked from being in communication with each other, the second supply portion 813 may be shielded by the outer surface of the movable casing 824.

In this regard, when the movable casing 824 is sufficiently moved toward the oil supply portion 811, the first supply portion 812 and the first communication hole 824*a* may be in communication with each other.

Accordingly, the oil supplied from the oil supply portion 811 may be supplied to the first supply portion 812 because of the first communication hole 824*a*.

Thereafter, when the compressor 10 stops being driven or is driven again at the low pressure ratio, the compressor 10 may be in the state of (b) in FIG. 7. That is, the elastic portion 830 may be extended, and the movable casing 824 may move toward the acting portion 814.

In other words, when the movable casing 824 is in contact with the acting portion 814, the second communication hole 824*c* may be in communication with the second supply portion 813, and when the movable casing 824 is spaced apart from the acting portion 814, the second communication hole 824*c* may be blocked from being in communication with the second supply portion 813.

When the movable casing 824 is in contact with the acting portion 814, the first communication hole 824*a* may be blocked from being in communication with the first supply portion 812, and when the movable casing 824 is spaced apart from the acting portion 814, the first communication hole 824*a* may be in communication with the first supply portion 812.

As a result, the adjusting portion 800 may selectively open and close the first passage 3293 and the second passage 3294 without separate electrical control depending only on the pressure of the discharged refrigerant.

Figure 8:
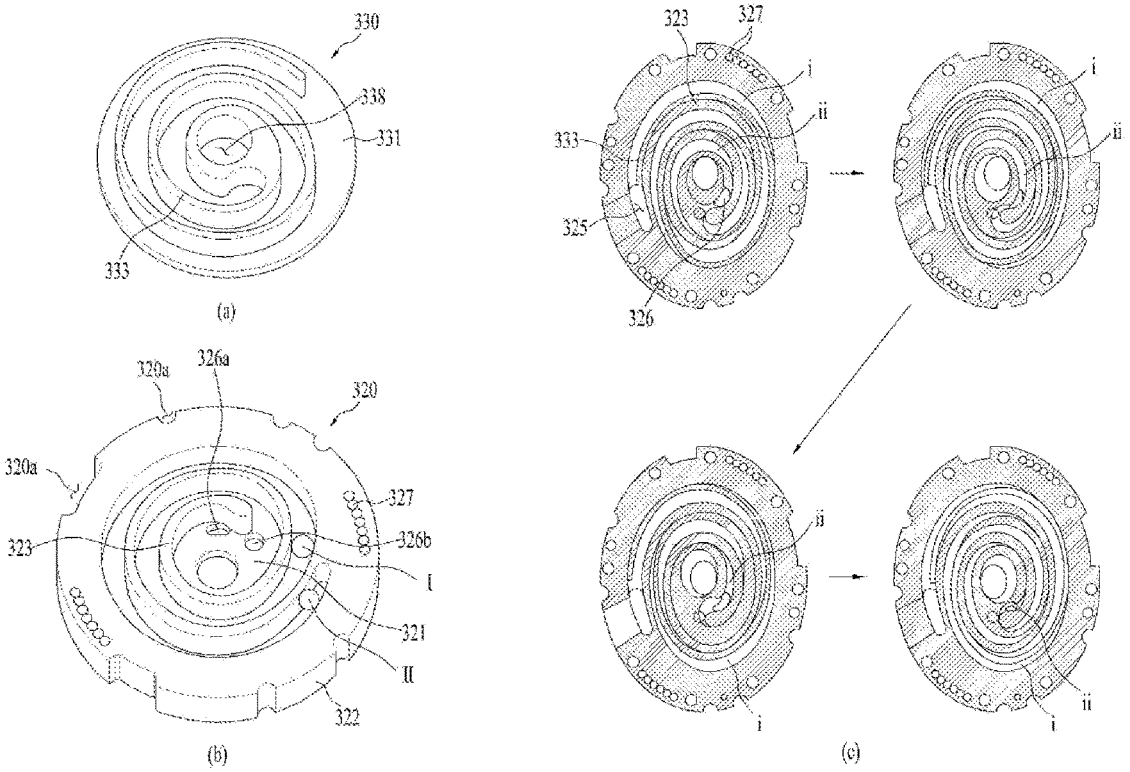
FIG. 8 shows an operation scheme of a compressor according to the present disclosure.

FIG. 8 shows an operation scheme of a compressor according to the present disclosure.

(a) in FIG. 8 shows an orbiting scroll, (b) in FIG. 8 shows a fixed scroll, and (c) in FIG. 8 shows a process in which the orbiting scroll and the fixed scroll compress the refrigerant.

The orbiting scroll 330 may include the orbiting wrap 333 on one surface of the orbiting end plate 331, and the fixed scroll 320 may include the fixed wrap 323 on one surface of the fixed end plate 321.

In addition, the orbiting scroll 330 may be formed as a sealed rigid body so as to prevent the refrigerant from being discharged to the outside, but the fixed scroll 320 may have the suction hole 325 in communication with a refrigerant supply pipe such that the low-temperature and low-pressure refrigerant, such as liquid, flows thereinto, and the discharge hole 326 through which the high-temperature and high-pressure refrigerant is discharged, and may have the bypass hole 327 through which the refrigerant discharged from the discharge hole 326 is discharged defined in an outer circumferential surface thereof.

In one example, the fixed wrap 323 and orbiting wrap 333 may be formed in an involute shape so as to be engaged with each other at at least two points, thereby forming the compression chamber in which the refrigerant is compressed.

The involute shape means a curve corresponding to a trajectory drawn by an end of a thread when unwinding the thread wound around a base circle having an arbitrary radius as shown.

However, the fixed wrap 323 and the orbiting wrap 333 according to the present disclosure are formed by combining 20 or more arcs with each other, and are able to vary in a radius of curvature for each portion.

That is, the compressor according to the present disclosure is provided such that the rotating shaft 230 extends through the fixed scroll 320 and the orbiting scroll 330, so that the radius of curvature and the compression space of each of the fixed wrap 323 and the orbiting wrap 333 are reduced.

Therefore, in order to compensate for the same, in the compressor according to the present disclosure, radii of curvature of the fixed wrap 323 and the orbiting wrap 333 immediately before the discharge may be smaller than that of the shaft accommodating portion through which the rotating shaft extends such that the space in which the refrigerant is discharged may be reduced and the compression ratio may be increased.

That is, the fixed wrap 323 and the orbiting wrap 333 may be bent more severely in the vicinity of the discharge hole 326, and may vary in the radius of curvature for each point corresponding to the bent portion in a direction toward the suction hole 325.

Referring to (c) in FIG. 8, the refrigerant I is introduced into the suction hole 325 of the fixed scroll 320, and the refrigerant II introduced earlier than the refrigerant I is located in the vicinity of the discharge hole 326 of the fixed scroll 320.

In this regard, the refrigerant I is present in a region defined as the fixed wrap 323 and the outer surface of the orbiting wrap 333 are engaged with each other, and the refrigerant II is sealed and present in a region in which the fixed wrap 323 and the orbiting wrap 333 are engaged with each other at two points.

Thereafter, when the orbiting scroll 330 starts to orbit, the region in which the fixed wrap 323 and the orbiting wrap 333 are engaged with each other at the two points starts to be reduced in a volume while moving along an extension direction of the fixed wrap 323 and the orbiting wrap 333 based on the change of the position of the orbiting wrap 333, and the refrigerant I starts to be compressed while flowing. The refrigerant II is further reduced in volume, compressed, and starts to be guided to the discharge hole 326.

The refrigerant II is discharged from the discharge hole 326, and the refrigerant I flows as the region in which the fixed wrap 323 and the orbiting wrap 333 are engaged with each other at the two points moves in a clockwise direction, is reduced in volume, and starts to be further compressed.

As the region in which the fixed wrap 323 and the orbiting wrap 333 are engaged with each other at the two points moves in the clockwise direction again and gets closer to the inside of the fixed scroll, the volume thereof is further reduced and compressed, and the refrigerant II is almost completely discharged.

As such, as the orbiting scroll 330 orbits, the refrigerant may be compressed linearly or continuously while flowing into the fixed scroll.

The drawing shows that the refrigerant is discontinuously introduced into the suction hole 325, but this is only for illustration. The refrigerant may be continuously supplied, and the refrigerant may be accommodated and compressed in each region in which the fixed wrap 323 and the orbiting wrap 333 are engaged with each other at two points.

The present disclosure may be modified and implemented in various forms, so that the scope of rights thereof is not limited to the above-described embodiment. Therefore, when the modified embodiment includes the components of the claims of the present disclosure, it should be viewed as belonging to the scope of the present disclosure.

The present disclosure may be modified and implemented in various forms, so that the scope of rights thereof is not limited to the above-described embodiment. Therefore, when the modified embodiment includes the components of the claims of the present disclosure, it should be viewed as belonging to the scope of the present disclosure.

The invention claimed is:

1. A compressor comprising:

a casing;

a driver coupled to an inner circumferential surface of the casing;

a rotating shaft coupled to the driver and configured to enable oil to flow therethrough; and a compressing portion coupled to the rotating shaft and configured to compress refrigerant and be lubricated with the oil, wherein the compressing portion includes:

an orbiting scroll including (i) an orbiting end plate supporting the rotating shaft and configured to orbit and (ii) an orbiting wrap extending along a circumference of the orbiting end plate and configured to compress the refrigerant, a fixed scroll including:

a fixed end plate defining (i) a suction hole configured to receive the refrigerant and (ii) a discharge hole spaced apart from the suction hole and configured to discharge the refrigerant, and a fixed wrap extending from the fixed end plate and facing the orbiting wrap, the fixed wrap being configured to compress the refrigerant, a main frame mounted at the fixed end plate and configured to accommodate the orbiting scroll, wherein the rotating shaft extends through the main frame, an oil supply passage configured to supply the oil delivered from the rotating shaft through the orbiting end plate or the fixed end plate to (i) a first passage defined between the orbiting wrap and the fixed wrap and (ii) a second passage defined closer to the suction hole than the first passage is, and an adjusting portion being in fluid communication with the oil supply passage, the first passage, and the second passage, the adjusting portion being configured to selectively supply the oil to at least one of the first passage or the second passage, wherein the adjusting portion includes:

a shielding portion configured to, based on an internal pressure of the casing, selectively open and close at least one of the first passage or the second passage, and a housing provided in the fixed end plate and configured to accommodate the shielding portion and enable the shielding portion to reciprocate, the housing being in fluid communication with the first passage, the second passage, and the oil supply passage, and wherein an end of the housing is exposed to an outside of the fixed end plate to thereby expose the shielding portion to the outside of the fixed end plate.

2. The compressor of claim 1, wherein the shielding portion is disposed within the fixed end plate and configured to selectively open and close the second passage based on the internal pressure of the casing.

3. The compressor of claim 2, wherein the housing includes:

an acting portion configured to transmit the internal pressure of the casing to the shielding portion;

an oil supply portion spaced apart from the acting portion and being in fluid communication with the oil supply passage, the oil supply portion being configured to deliver the oil into the housing;

a first supply portion separated from the acting portion and the oil supply portion and configured to deliver the oil to the first passage; and a second supply portion separated from the acting portion and the oil supply portion and configured to deliver the oil to the second passage, wherein the shielding portion is configured to move from the acting portion to the second supply portion and selectively restrict fluid communication between the second supply portion and the oil supply portion.

4. The compressor of claim 3, further comprising:

an elastic portion disposed between the second supply portion and the shielding portion and configured to move the shielding portion to close the acting portion.

5. The compressor of claim 4, wherein the elastic portion is configured to be compressed based on a reference pressure acting on the shielding portion.

6. The compressor of claim 5, wherein the housing includes an accommodating step having a diameter greater than a diameter of the second supply portion, the accommodating step being configured to accommodate an end of the elastic portion, and wherein the elastic portion has a diameter that is greater than the diameter of the second supply portion and smaller than the diameter of the accommodating step.

7. The compressor of claim 3, wherein the first supply portion is configured to remain open based on the shielding portion reciprocating from the acting portion to the second supply portion.

8. The compressor of claim 7, wherein the first supply portion is configured to be partially opened by the shielding portion based on the shielding portion closing the second supply portion.

9. The compressor of claim 3, wherein the shielding portion is configured to contact an inner wall of the housing to thereby restrict fluid communication between the acting portion and the first supply portion or the second supply portion.

10. The compressor of claim 3, wherein the shielding portion includes:

an opening/closing body configured to selectively close the oil supply portion or the first supply portion;

an extending body extending from the opening/closing body toward the acting portion; and a blocking body extending from the extending body and configured to close the acting portion.

11. The compressor of claim 2, wherein the housing includes:

an acting portion configured to transmit the internal pressure of the casing to the shielding portion;

an oil supply portion facing the acting portion and being in fluid communication with the oil supply passage, the oil supply portion being configured to deliver the oil into the housing;

a first supply portion separated from the acting portion and the oil supply portion and configured to deliver the oil to the first passage; and a second supply portion separated from the acting portion and the oil supply portion and configured to deliver the oil to the second passage, wherein the shielding portion is configured to selectively shield the first supply portion or the second supply portion.

12. The compressor of claim 11, wherein the adjusting portion includes an elastic portion accommodated in the housing and configured to move the shielding portion toward the acting portion, and wherein the shielding portion includes a movable casing that accommodates the elastic portion and defines (i) a first communication hole being in fluid communication with the first supply portion and (ii) a second communication hole being in fluid communication with the second supply portion.

13. The compressor of claim 12, wherein the second communication hole is configured to, based on the moving casing contacting the acting portion, be in fluid communication with the second supply portion, and wherein the second communication hole is configured to, based on the movable casing being spaced apart from the acting portion, be blocked from being in fluid communication with the second supply portion.

14. The compressor of claim 12, wherein the first communication hole is configured to, based on the movable casing contacting the acting portion, be blocked from being in fluid communication with the first supply portion, and wherein the first communication hole is configured to, based on the movable casing being spaced apart from the acting portion, be in fluid communication with first second supply portion.

15. A compressor comprising:

an orbiting scroll including (i) an orbiting end plate configured to orbit and (ii) an orbiting wrap extending along a circumference of the orbiting end plate and configured to compress refrigerant;

a fixed scroll including:

a fixed end plate defining (i) a suction hole configured to receive the refrigerant and (ii) a discharge hole spaced apart from the suction hole and configured to discharge the refrigerant, and a fixed wrap extending from the fixed end plate and facing the orbiting wrap, the fixed wrap being configured to compress the refrigerant;

a main frame mounted at the fixed end plate and configured to accommodate the orbiting scroll;

an oil supply passage configured to supply oil through the orbiting end plate or the fixed end plate to (i) a first passage defined between the orbiting wrap and the fixed wrap and (ii) a second passage defined closer to the suction hole than the first passage is; and an adjusting portion being in fluid communication with the oil supply passage, the first passage, and the second passage, the adjusting portion being configured to selectively supply the oil to at least one of the first passage or the second passage, wherein the adjusting portion includes:

a shielding portion configured to, based on an internal pressure of a casing of the compressor, selectively open and close at least one of the first passage or the second passage, and a housing provided in the fixed end plate and configured to accommodate the shielding portion and enable the shielding portion to reciprocate, the housing being in fluid communication with the first passage, the second passage, and the oil supply passage, and wherein an end of the housing is exposed to an outside of the fixed end plate to thereby expose the shielding portion to the outside of the fixed end plate.

16. The compressor of claim 15, wherein the shielding portion is disposed within the fixed end plate and configured to selectively open and close the second passage based on the internal pressure of the casing.

* * * * *